US011316293B2

(12) United States Patent
Kufner et al.

(10) Patent No.: US 11,316,293 B2
(45) **Date of Patent: *Apr. 26, 2022**

(54) ELECTRICAL CONTACT ELEMENT COMPRISING A CARRIER STRIP AND A PLURALITY OF CONTACT PARTS

(71) Applicant: STAUBLI ELECTRICAL CONNECTORS AG, Allschwil (CH)

(72) Inventors: Tom Kufner, Riehen (CH); Philipp Alexander Strehler, Basel (CH); Fabian Hilti, Ziefen (CH); Lucas Wirz, Basel (CH)

(73) Assignee: STAUBLI ELECTRICAL CONNECTORS AG, Allschwil (CH)

( * ) Notice: Subject to any disclaimer, the term of this patent is extended or adjusted under 35 U.S.C. 154(b) by 472 days.

This patent is subject to a terminal disclaimer.

(21) Appl. No.: 16/303,738

(22) PCT Filed: May 19, 2017

(86) PCT No.: PCT/EP2017/062065
§ 371 (c)(1),
(2) Date: Nov. 21, 2018

(87) PCT Pub. No.: WO2017/202707
PCT Pub. Date: Nov. 30, 2017

(65) Prior Publication Data

US 2020/0328544 A1 Oct. 15, 2020

(30) Foreign Application Priority Data

May 25, 2016 (EP) ..... 16171340
May 25, 2016 (EP) ..... 16171341
May 25, 2016 (EP) ..... 16171346

(51) Int. Cl.
*H01R 13/24* (2006.01)
*H01R 4/48* (2006.01)
(Continued)

(52) U.S. Cl.
CPC ..... *H01R 13/24* (2013.01); *H01R 4/4881* (2013.01); *H01R 13/15* (2013.01);
(Continued)

(58) Field of Classification Search
CPC ..... H01R 4/48; H01R 4/4881; H01R 13/24; H01R 13/2457–2492; H01R 43/007; H01R 13/15; H01R 43/04
See application file for complete search history.

(56) References Cited

U.S. PATENT DOCUMENTS 4,456,325 A 6/1984 Benz
5,261,840 A 11/1993 Benz
(Continued)

FOREIGN PATENT DOCUMENTS

CN 104600456 A 5/2015
DE 3014118 B1 2/1981
(Continued)

OTHER PUBLICATIONS

International Search Report of PCT/EP2017/062065 dated Jul. 13, 2017.
(Continued)

*Primary Examiner* — Renee S Luebke
*Assistant Examiner* — Milagros Jeancharles
(74) *Attorney, Agent, or Firm* — Sughrue Mion, PLLC

(57) ABSTRACT

A contact element (1) for establishing electric contact between two contact pieces (K1, K2) comprises a support strip (2) extending in a longitudinal direction (L) as well as a plurality of contact parts (5, 5*a*, 5*b*), each of which has a first contact section (6) for contacting one of the two contact
(Continued)

pieces (K1, K2), a second contact section (7) for contacting the other one of the two contact pieces (K2, K1), and a fastening section (8) for securing the contact part (5, 5*a*, 5*b*) to the support strip (2).

27 Claims, 21 Drawing Sheets

(51) Int. Cl.
*H01R 43/00* (2006.01)
*H01R 13/15* (2006.01)

(52) U.S. Cl.
CPC ..... *H01R 13/2457* (2013.01); *H01R 13/2492* (2013.01); *H01R 43/007* (2013.01)

(56) References Cited

U.S. PATENT DOCUMENTS

| | | | | |
|---|---|---|---|---|
| D463,338 | S | 9/2002 | Ioka | |
| 6,547,607 | B2 * | 4/2003 | Moll | H01R 13/187 439/816 |
| D476,623 | S | 7/2003 | Oohashi | |
| 7,078,614 | B1 | 7/2006 | Van Haaster | |
| 8,057,269 | B2 * | 11/2011 | Ledermann | H01R 13/187 439/827 |
| 8,821,170 | B1 | 9/2014 | Thein et al. | |
| D753,066 | S | 4/2016 | Sturgess | |
| 2001/0019923 | A1 | 9/2001 | Moll et al. | |
| 2005/0095912 | A1 | 5/2005 | Yang | |
| 2010/0093230 | A1 | 4/2010 | Ledermann et al. | |
| 2010/0227507 | A1 | 9/2010 | Cheng | |
| 2010/0330821 | A1 | 12/2010 | Takeuchi | |
| 2012/0088383 | A1 | 4/2012 | Qu | |
| 2012/0115340 | A1 | 5/2012 | Yamamoto | |
| 2014/0127954 | A1 * | 5/2014 | Ando | H01R 13/113 439/884 |
| 2016/0226181 | A1 | 8/2016 | Sturgess | |
| 2017/0225225 | A1 | 8/2017 | Sarkisian | |

FOREIGN PATENT DOCUMENTS

| | | | |
|---|---|---|---|
| EP | 0 716 474 | A1 | 6/1996 |
| EP | 1 119 077 | A1 | 7/2001 |
| EP | 2115820 | | 11/2009 |
| EP | 2693573 | A2 | 2/2014 |
| GB | 2398680 | A | 8/2004 |
| WO | 2008/092284 | A1 | 8/2008 |

OTHER PUBLICATIONS

Communication dated Oct. 25, 2016, from the European Patent Office in counterpart European Application No. 16171340.9.
Communication dated Oct. 25, 2016, from the European Patent Office in counterpart European Application No. 16171341.7.
Communication dated Oct. 25, 2016, from the European Patent Office in counterpart European Application No. 16171346.6.
International Search Report of PCT/EP2017/062066 dated Jul. 14, 2017.
International Search Report of PCT/EP2017/062067 dated Jul. 13, 2017.
Multilam Contact Band Technology for Tool Changers, posted at Robotics.org, posted on Oct. 24, 12, site visited 11/0 (Year: 2012), 1 page total.
The New Multilam ML-I, posted at Ec.staubli.com, posted on Apr. 16, 2015, site visited Nov. 9, 2017. online, Avail (Year: 2015), 1 page total.
New high-performance Multilam LA-CUDD, posted at Ec.staubli.com, posted on Oct. 25, 2012, site visited 11/ (Year: 2012), 1 page total.

* cited by examiner

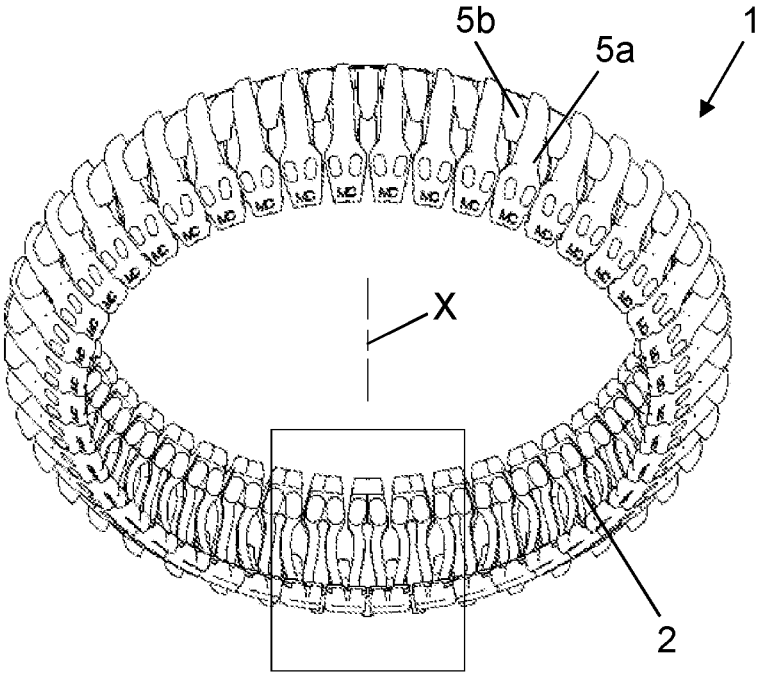
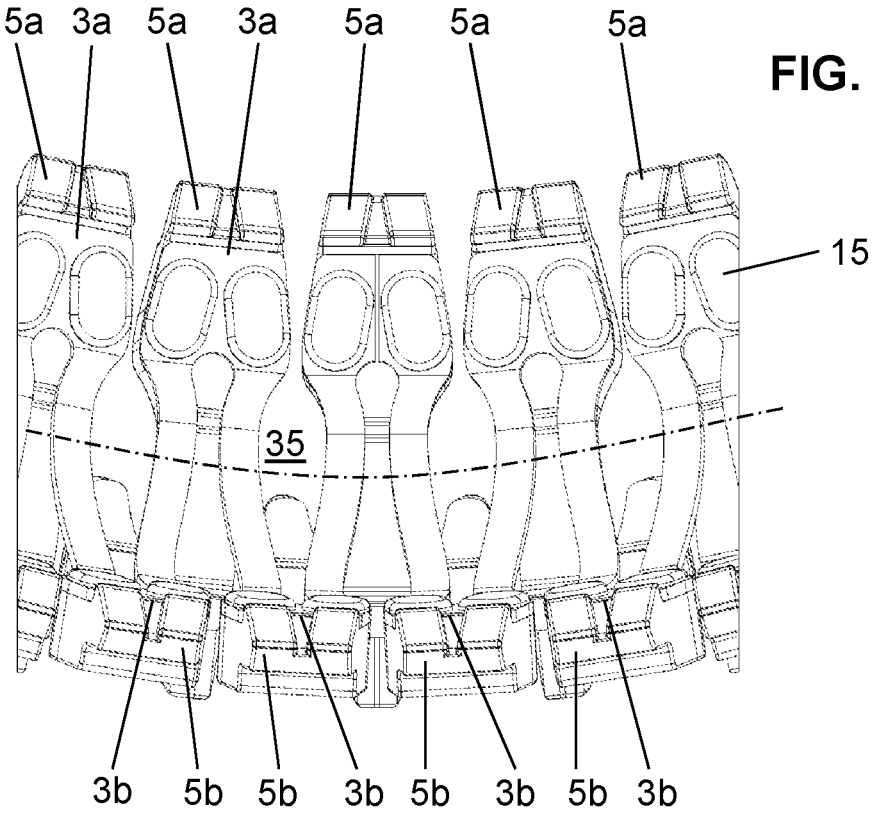
FIG. 10a
FIG. 10b

ELECTRICAL CONTACT ELEMENT COMPRISING A CARRIER STRIP AND A PLURALITY OF CONTACT PARTS

CROSS REFERENCE TO RELATED APPLICATIONS

This application is a National Stage of International Application No. PCT/EP2017/062065 filed May 19, 2017, claiming priority based on European Patent Application No. 16171340.9 filed May 25, 2016, European Patent Application No. 16171346.6 filed May 25, 2016, and European Patent Application No. 16171341.7 filed May 25, 2016.

TECHNICAL FIELD

The present invention relates to a contact element for establishing electrical contact between two contact pieces according to the preamble of claim 1.

PRIOR ART

The prior art has disclosed contact elements which can also be called contact lamellae. For example, EP 0 716 474 describes a contact element that comprises a unipartite contact strip that extends along a longitudinal direction and by way of which two opposite contact faces can be electrically connected. The length of the contact strip can be slightly deformed, so that said contact strip can be installed in a simple manner.

Even though the deformation of the contact strip during installation is highly advantageous, the contact lamella according to EP 0 716 474 exhibits a few disadvantages.

Firstly, the scalability in respect of the electric currents to be transmitted is highly limited. An increase in the current is typically also accompanied by an increase in the cross section of the contact element. Scaling of this kind is not readily possible because otherwise advantageous properties are lost. For example, the contact element becomes stiffer in the event of an increase.

Secondly, the mechanical plugging force can be influenced only to a slight extent in the case of use of the lamella in a socket or plug connection.

Furthermore, also the insertion area resp. deflection area in respect of the geometric dimensions between the two contact areas is limited.

SUMMARY OF THE INVENTION

Proceeding from this prior art, the object of the invention is to specify a contact element that overcomes the disadvantages of the prior art. A particular aim is that the contact element can be configured more easily for various applications.

This object is achieved by a contact element as claimed in claim 1. According to said claim, a contact element for establishing electrical contact between two contact pieces comprises a carrier strip that extends in the longitudinal direction and a plurality of contact parts that are connected to the carrier strip. The contact parts each comprise at least a first contact section for making contact with one of the two contact pieces, at least one second contact section for making contact with the other of the two contact pieces, and also at least one fastening section for fastening the contact part to the carrier strip. The contact parts are connected to the carrier strip at a fastening spot by means of the fastening section. A line extends through the carrier strip in the longitudinal direction. The line is preferably a line that is situated centrally in the carrier strip. The contact parts are situated in relation to the carrier strip in such a way that the contact parts are pivoted resp. can be pivoted about a pivot line. The pivot line is situated in a manner angularly inclined at an angle of less than 30°, in particular substantially parallel, in relation to said line.

The angle therefore lies in the range of from 0° to 30°. A pivot line that is situated substantially parallel is intended to be understood to mean that the pivot line is situated precisely parallel or at a small angle of up to 0° or up to 5° in relation to the line. In this case, the pivot lines of individual contact parts run parallel with respect to one another but not in a collinear manner.

Owing to this design, the contact parts are deflected substantially parallel in relation to the insertion direction. Said pivot line is preferably situated orthogonally in relation to the insertion direction.

In other words, the substantial orientation of the contact part is preferably transverse in relation to the longitudinal direction. In the case of a contact process, this has the result that the contact part pivots about the pivot line, which is oriented at a right angle in relation to the insertion direction in the installation position, in the event of a contact movement.

In the case of a contact process, the orientation of the contact parts transverse in relation to the carrier strip has the result that the contact part pivots about the pivot line, which is oriented at a right angle in relation to the insertion direction in the installation position, in the event of a contact movement.

Owing to the arrangement of the contact parts so that the described manner of pivoting is made possible, the contact parts are pivoted substantially in the insertion direction during installation, as a result of which the stress for the carrier strip is lower. Furthermore, the contact element for the plug-in connector can be dimensioned in a simple manner. In particular, the contact parts can be dimensioned independently and freely of the carrier strip. Particularly preferably, the cross section of the contact parts can be changed in a very simple manner.

Depending on the installation position, the carrier strip extends cylindrically around a center axis, wherein the line and the pivot line then likewise extend cylindrically around the center axis. In this context, the expression that the line and the pivot line are parallel is intended to be understood to mean that the cylindrically circulating line and the cylindrically circulating pivot line are situated in parallel planes that are transverse in relation to the center axis. This configuration of the installation position occurs, for example, in the case of a socket and plug connection.

Owing to the arrangement of the contact parts, which are responsible for actually establishing electrical contact, a defined electrical contact can be achieved between the two contact pieces. Furthermore, in the case of deformation of the carrier strip during the contact process, the contact parts, which are provided for electrical contact, are not deformed and as a result negatively influenced, but rather the carrier strip is mechanically deformed.

The contact part preferably moves relative to the contact face of the corresponding contact piece during pivoting about the pivot line, wherein the movement runs transverse in relation to the pivot line. Said movement is a combined movement of the contact part, which movement is made up of the pivot movement and of the movement on the contact face.

The second contact section is preferably situated in the region of the fastening section. Furthermore, the contact part is designed with a rounded portion in the second contact section, which rounded portion extends around a rounded portion axis that runs parallel to the longitudinal direction. The rounded portion axis and the pivot line run in a substantially collinear manner in relation to one another at least over the width of the contact part.

The second contact section preferably rolls, by way of its rounded portion, on the contact face and is optionally designed such that it can be displaced with respect to the contact face.

The carrier strip preferably has a substantially constant cross section over its length in the longitudinal direction and is substantially rigid as seen in the longitudinal direction. The expression 'rigid' is intended to be understood to mean that no means are provided on the carrier strip which would allow a relatively large change in length given a relatively small action of force. However, the carrier strip has elastic properties, which allow the contact parts to deflect.

As an alternative, the carrier strip that extends in the longitudinal direction is designed in such a way that, when a force is applied to the carrier strip, the length of the carrier strip changes in the longitudinal direction.

The carrier strip is preferably formed from a flat strip whose thickness is several times smaller than the width of said flat strip. The cross section of the flat strip is preferably rectangular.

The fastening spots are preferably situated in the edge region of the carrier strip. In other words, the fastening spots are situated at the outer edge of the carrier strip.

However, the carrier strip can also be designed in a different way. For example, the fastening sections can be designed as fastening lugs which protrude away from a rectangular strip.

In one embodiment, contact parts are arranged on either side in relation to the carrier strip.

In another embodiment, contact parts are arranged on one side of the carrier strip.

The contact parts preferably extend from the respective fastening spot, by way of which the corresponding contact part is connected to the carrier strip, beyond the line which extends in the longitudinal direction. That is to say that the contact parts protrude beyond the line transverse in relation to the line. In this context, the line is preferably a center line.

Contact parts are preferably arranged on either side in relation to the carrier strip, wherein there is an intermediate space between two contact parts which are arranged adjacent to one another on the same side, it being possible for a contact part that is arranged on the other side to protrude into said intermediate space.

A second contact part preferably extends into the intermediate space that is situated between two adjacent first contact parts, and a first contact part extends into the intermediate space that is situated between two adjacent second contact parts.

In other words, the contact parts are arranged in an interleaved manner in relation to one another.

Contact parts are preferably arranged to the left and to the right with respect to the line, in particular the center line. In this context, it is possible to refer to a left-hand side and a right-hand side with respect to the carrier strip, wherein one contact part is connected to the right-hand side and another contact part is connected to the left-hand side. The contact parts are arranged in a manner offset in relation to one another as seen along the line, in particular the center line.

Preferably, the first contact part that is connected to the right-hand side of the carrier strip is oriented, by way of its first contact section, toward the second contact part that is connected to the left-hand side of the carrier strip and/or the second contact part that is connected the left-hand side of the carrier strip is oriented by way of its first contact section toward the first contact part that is connected to the right-hand side of the carrier strip.

Preferably, the carrier strip that extends in the longitudinal direction comprises a plurality of fastening spots, which are arranged at a distance in relation to one another in the longitudinal direction, such that a plurality of contact parts are provided, as seen in the longitudinal direction. The contact parts are fastened to a fastening spot by the fastening section for fastening the contact part.

The contact parts are designed separately from the carrier strip and are fixedly connected to the carrier strip by means of the fastening section. The contact part is preferably connected to the carrier strip by means of a mechanical connection. The contact part can be connected to the carrier strip in an interlocking manner and/or cohesive manner and/or force-fitting manner. The fastening section of the contact part and the carrier strip resp. the fastening spots of the carrier strip have corresponding elements, which enable the fastening.

The material of the carrier strip is preferably different from the material of the contact part. The material of the carrier strip preferably has good elastic deformation properties, so that deflection of the contact parts is ensured, and the material of the contact part preferably exhibits a good electrical conductivity.

The material of the carrier strip is preferably composed of metal, in particular steel, particularly preferably spring steel or stainless spring steel. The material of the contact part is preferably composed of copper or alloys thereof. The contact part is preferably provided with a coating that improves electrical contact. For example by a silver coating.

The carrier strip is preferably produced by a sheet-metal strip, in particular a sheet-metal strip that is shaped by means of a punching process or laser cutting. However, the sheet-metal strip can also be produced in some other way.

Preferably, the first contact part, as seen from its fastening spot, extends in such a way that the first contact section, as seen transverse in relation to the longitudinal direction, extends beyond a second contact part in such a way that, in the event of a contact movement from the side of the second contact part, the first contact part is first contacted by the contact piece.

Particularly good connection of the contact parts can be achieved in this way. Furthermore, the compactness of the contact element can be increased.

Similarly, the second contact parts are preferably arranged, with the second contact section, as seen transverse in relation to the longitudinal direction, extending beyond a first contact part, in such a way that, in the event of a contact movement from the side of the first contact element, the second contact element is first contacted by the contact piece.

The carrier strip is preferably designed in a manner bent about a line that is situated between the fastening spots, in particular bent in a curved manner and/or bent once and/or bent several times, so that the surface of the fastening spots, which are arranged on one side of the line, is situated in a manner inclined at an angle in relation to the surface of the fastening spots, which are arranged on the other side of the line.

In other words: Are seen in cross section at a right angle in relation to the line, the fastening spots extend in a manner inclined at an angle in relation to a center region of the carrier strip.

Owing to the bent design, the carrier strip acts as a spring element in such a way that the respective contact element can be pivoted from an initial position to a contact position about its second contact section.

In other words: The carrier strip preferably has at least one bending line that extends parallel in relation to the longitudinal direction, wherein the fastening spots run starting from the bending line in a manner inclined at an angle with respect to a plane that is spanned by the longitudinal direction and a transverse axis that is situated transverse in relation thereto, such that the contact parts are situated in a manner inclined at an angle in relation to said contact faces of the contact pieces or in relation to said plane.

In one variant, the carrier strip is designed with a curved portion. Consequently, the carrier strip extends between the fastening spots in the form of a curved portion from fastening spot to fastening spot. The carrier strip is preferably designed in a manner curved about the line that runs in the direction of the longitudinal axis. The radius of the curved portion is advantageously selected to be as large as possible depending on the installation situation.

In another variant, two bending lines are provided for each side. The two bending lines are situated at a distance in relation to one another and are preferably symmetrical, that is to say positioned at the same distance from a line which is situated centrally between the two fastening spots.

The bending lines can be of rounded design or can be designed as sharp corners.

Owing to the bent or multiply bent design of the web, it can also be stated that the carrier strip is of V-shaped or ti-shaped or trapezoidal or semicircular design in cross section transverse in relation to the longitudinal direction.

The first contact section preferably forms a free end with respect to the carrier strip and protrudes away from or sticks out of the carrier strip. The first contact section therefore does not lie on top of the carrier strip at least in the initial position, which is to say in the non-deflected state. However, the first contact section, depending on the design, can come into contact with the carrier strip in the contact position. The free end can protrude through the carrier strip through a recess in the carrier strip in the deflected state, i.e. in the contact position. The recess is provided by the intermediate region between two webs.

The second contact section is preferably situated in the region of the fastening section, which fastening section is fixedly connected to the fastening spot. As an alternative, the fastening section is arranged between the first contact section and the second contact section, wherein the two contact sections, as free ends, protrude away from the carrier strip at least in the non-deflected state or sticks out of said carrier strip.

The contact part is preferably designed with a rounded portion in the first contact section, which rounded portion extends around a rounded portion axis which runs parallel in relation to the longitudinal direction, and/or the contact part is designed with a rounded portion in the second contact section, which rounded portion extends around a rounded portion axis which runs parallel in relation to the longitudinal direction. The required insertion force can be optimized due to the rounded portions.

The rounded portion radii can be matched to the contact situation.

A rounded portion can be understood to mean a rounded portion with a constant radius or a non-constant radius or an n-gonal shape or a polygonal chain.

The second contact section of the contact part is preferably situated in relation to the carrier strip in such a way that the carrier strip and possibly the rivet do not come into connection with the contact piece in the contact position. For example, the second contact section can be offset or bent away from the bottom side of the connecting section that is situated on the carrier strip. The second contact section can therefore be part of a raised portion with respect to the fastening section.

The cross section of the contact part in the region of the fastening section is preferably larger than the cross section of the contact part in the region of the first contact section. The cross section of the first contact section is therefore designed in a tapered manner with respect to the fastening section. As an alternative or in addition, the cross section of the contact part in the region of the fastening section is larger than the cross section of the contact part in the region of the second contact section. As an alternative, the cross section of the contact part in the region of the fastening section can be substantially equal to the cross section in the region of the second contact section.

The contact part can therefore be formed in a manner reduced in size in sections.

As a result, effective mounting of the fastening section on the fastening spot can be achieved with optimum utilization of material.

The contact part particularly preferably tapers from the fastening section toward the first contact section.

As explained above, the contact part is fastened to the fastening spot of the carrier strip by means of the fastening section. In this case, the fastening section can be formed in various ways.

In a first embodiment, the contact part, by way of the fastening section, is connected to the fastening spot by at least one plastically deformable connecting element, in particular a rivet, wherein the at least one connecting element is formed in one piece with the contact part. The connecting element, in particular the rivet, is therefore an integral constituent part of the contact part.

Preferably, multiple connecting elements or rivets, in particular at least two thereof, are provided.

In this case, the connecting elements or rivets extend away from a bottom side of the contact part, which faces the carrier strip, protrude through apertures in the fastening spot and are plastically deformed on that side of the carrier strip that is opposite the support of the contact part.

To assist plastic deformation, the connecting element or the rivet can also further be welded.

The at least one connecting element or the rivet preferably has a round or an oval or a polygonal or an n-gonal cross section. The at least one connecting element particularly preferably has a cross section that complements an elongate hole. That is to say, the cross section is substantially in the shape of a rectangle, wherein two opposite side edges are formed in a rounded manner.

In a second and a third embodiment, the contact part is connected to the fastening spot by way of at least one rivet in the fastening section. The rivet protrudes through the fastening section and the fastening spot of the carrier strip.

In the second and the third embodiment, it is advantageous, for the purpose of receiving the rivet, if during production of the contact parts and of the carrier strip apertures are already prefabricated at the corresponding spots, that is to say in the fastening section and in the fastening spot. The rivet therefore extends through an aperture in the fastening spot and an aperture in the fastening section. The number of apertures corresponds to the number of rivets.

The rivet according to the second embodiment is preferably arranged between the first contact section and the second contact section.

According to the third embodiment, the rivets are preferably designed from an electrically conductive material and are electrically conductively connected to the contact part. Furthermore, said second contact section of the contact part can be provided by the rivet.

The rivet of the first embodiment could also be designed in such a way that it provides said second contact section.

In addition, the connection according to the first, the second and the third embodiment between the rivet and fastening section and fastening spot could further be assisted by a welded connection or by a soldered connection.

According to a fourth embodiment, the contact part with the fastening section for fastening to the fastening spot at least partially or completely surrounds the fastening spot. The fastening spot is therefore at least partially surrounded by the fastening section, which is to say that the fastening section extends at least partially around the fastening spot.

In this fourth embodiment, it is preferred that an outer edge of the fastening spot, which outer edge runs parallel in relation to the longitudinal direction, and surfaces of the fastening spot that adjoin said outer edge are at least partially surrounded or completely surrounded by the contact part.

In the present case, the second contact section extends substantially around said edge.

In other words, the contact part is connected to the fastening spot by means of a kind of crimped connection. Said connection is a force-fitting and/or interlocking connection in this case. The crimped connection can additionally be further reinforced by means of a soldered or welded connection.

In a fifth variant, the contact part is fastened to the fastening spot by way of at least one clip element.

The clip element is preferably positioned in the region of a slot which extends into the second contact section.

The clip element can further have barbs that get caught up with the contact part and with the fastening spot.

In one development of the contact element according to the above description, the ends of the carrier strip are connected to one another, so that a contact element that extends around a center axis results, wherein the two ends are preferably connected to one of said contact parts, or wherein the ends are connected to one another by way of a separate element. Therefore, a ring is produced.

Depending on the orientation, the contact parts are situated within the carrier strip or outside the carrier strip.

An arrangement of an above-described contact element and also a first contact piece and a second contact piece is distinguished in that the contact element abuts, by way of its first contact section, against the first contact piece and, by way of the second contact section, against the second contact piece.

According to one development of the arrangement, the first contact piece is a socket part that extends around a center axis and the second contact piece is a pin part that extends around the center axis, wherein the carrier strip extends around the center axis, and wherein the longitudinal direction is situated transverse in relation to the center axis and extends around said center axis, and wherein the pivot line extends around the center axis of the socket part resp. the pin part.

The contact parts can preferably be brought into contact with the first contact piece by way of the respective first contact sections, and the contact parts are in contact with the second contact piece by way of the respective second contact sections, wherein the distance between the opposite second contact sections is increased in the event of a contact movement.

Further embodiments are set forth in the dependent claims.

BRIEF DESCRIPTION OF THE DRAWINGS

Preferred embodiments of the invention will be described below on the basis of the drawings, which serve merely for explanation and are not to be interpreted as being restrictive. In the drawings:

FIG. 10*a* shows a schematic view of a contact part according to the invention for arranging in a circumferential groove in a pin;

FIG. 10*b* shows a view of a detail of FIG. 10*a;*

DESCRIPTION OF PREFERRED EMBODIMENTS

Figure 1:
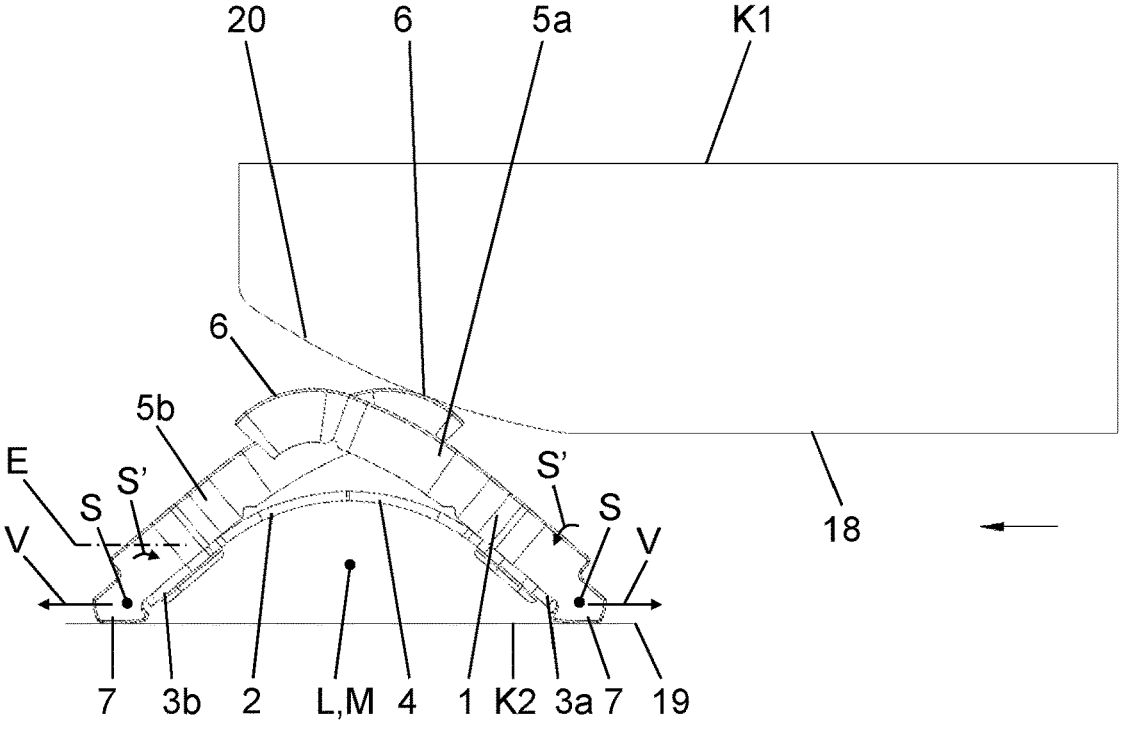
FIG. 1 shows a schematic view of a contact element and two contact pieces before the contact-making operation.
Figure 2:
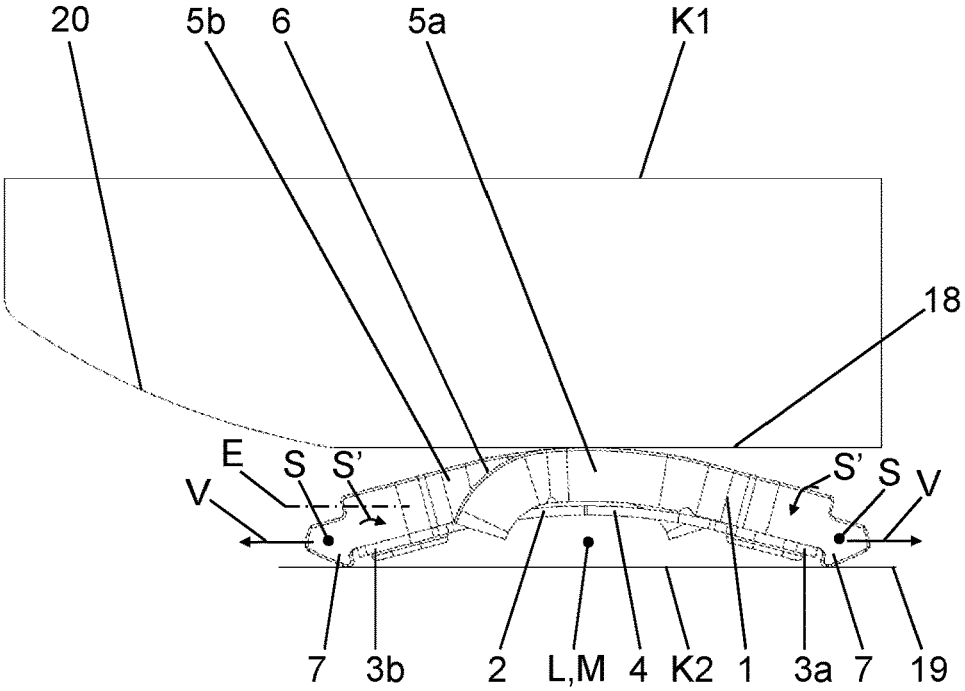
FIG. 2 shows the view according to FIG. 1 during the contact-making operation.

FIGS. 1 and 2 show a schematic illustration of two contact pieces K1, K2 and a contact element 1. In this case, the contact element 1 establishes electrical contact between the first contact piece K1 and the second contact piece K2. To this end, the contact element 1 makes contact with the contact face 18 of the contact piece K1 and with the contact face 19 of the contact piece K2. Due to its resilient properties which will be described in greater detail in the text that follows, the contact element is always pressed against the two contact faces 18, 19 of the contact pieces K1, K2 in the contact position, as it is shown in FIG. 2.

During the contact-making operation, the first contact piece K1 is displaced relative to the second contact piece K2. The first contact piece K1, by way of the contact face 18, which here is designed with a rounded portion 20 in the front region, then makes contact with the contact element 1. The first contact piece K1 is then further displaced relative to the second contact piece K2, until the contact face 18 is completely connected to the contact element 1. On doing so, the contact position that is shown in FIG. 2 is achieved.

The contact element 1 for establishing electrical contact between the two contact pieces K1, K2 comprises a carrier strip 2 that extends in the longitudinal direction L and a plurality of contact parts 5 that are connected to the carrier strip 2. The carrier strip 2 serves to support the contact parts 5 and not to establish electrical contact, whereas the contact parts 5 are provided for establishing electrical contact. In FIGS. 1 and 2, the longitudinal direction L runs at a right angle in relation to the surface of the drawing sheet. Depending on the installation position of the contact element, the longitudinal direction L can be curved or extend along a straight line. For example, when the contact element 1 is installed into a socket/plug combination, the longitudinal direction L is formed in a circumferential manner about a center axis. During contacting of two contact pieces K1, K2 that are substantially flat, the longitudinal direction L can extend along a straight line.

Figure 3:
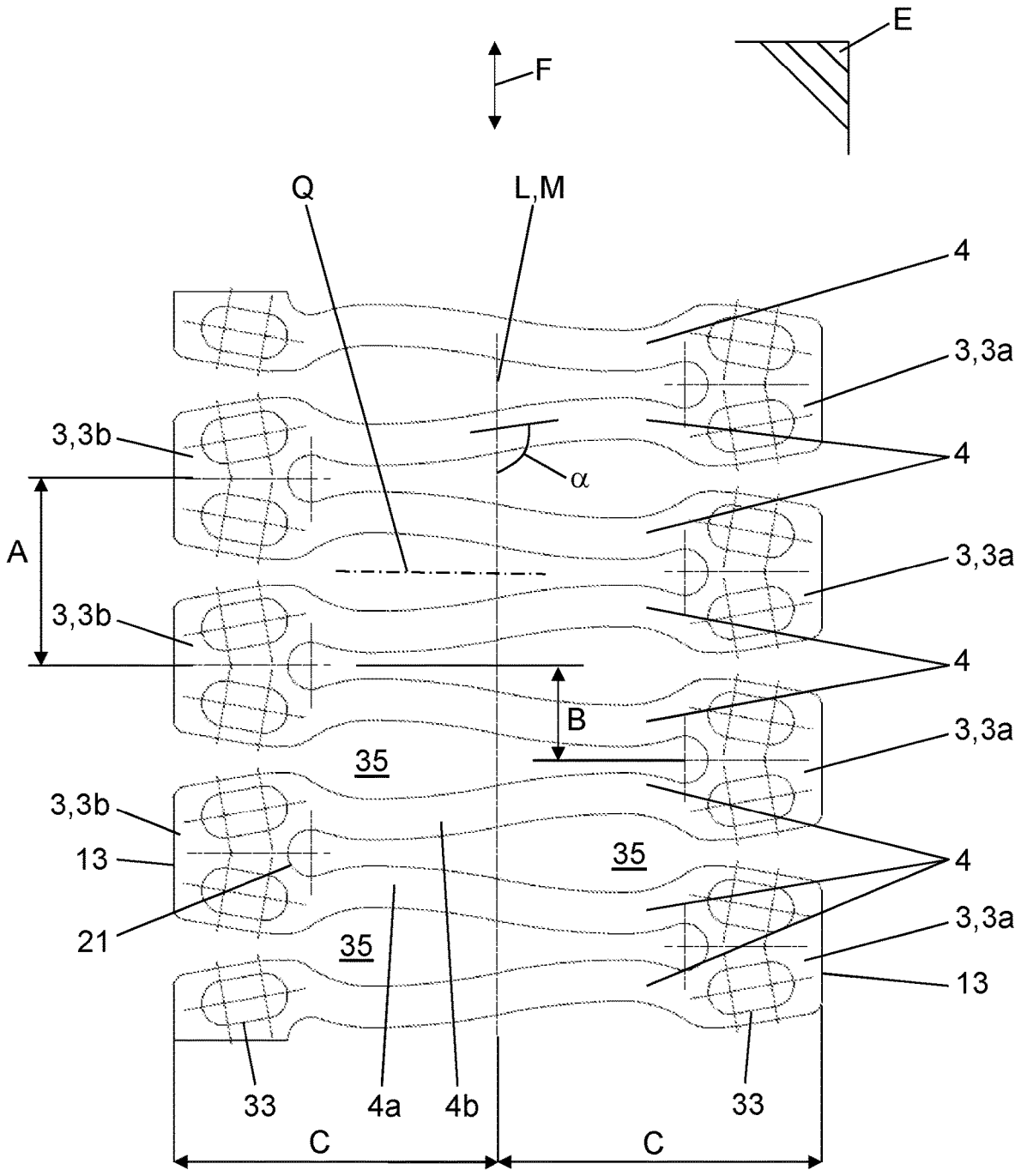
FIG. 3 shows a schematic view of a carrier strip of the contact element according to FIGS. 1 and 2.
Figure 4A:
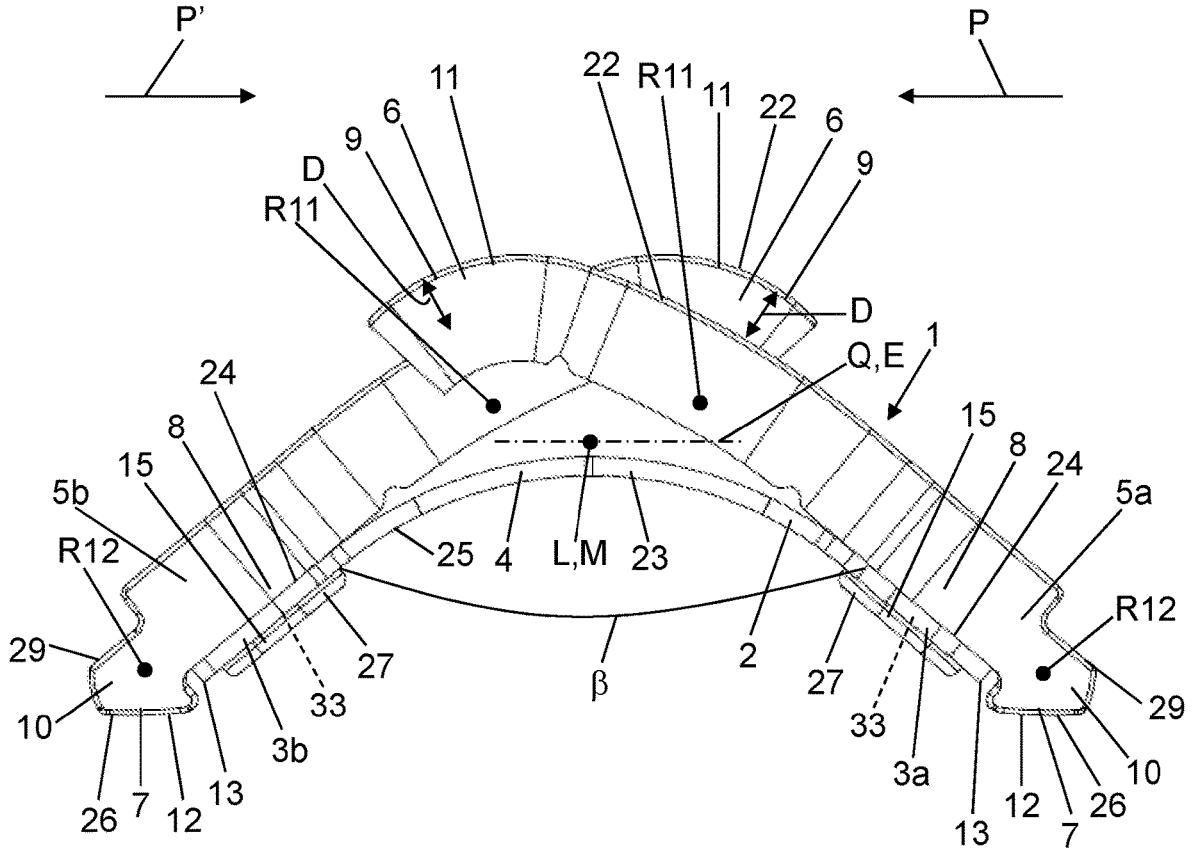
FIG. 4*a* shows a front view of a contact part according to a first embodiment of the present invention.
Figure 4B:
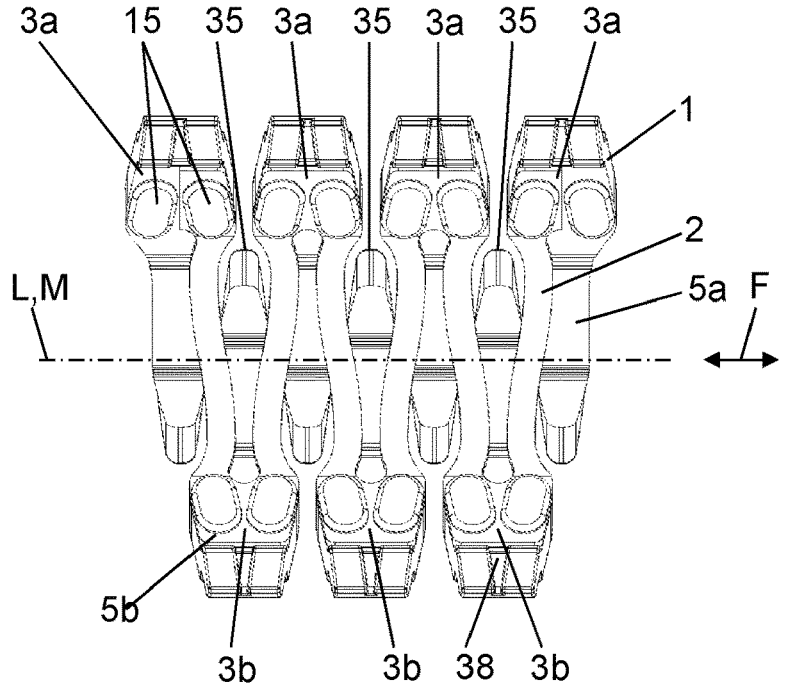
FIG. 4*h* shows a view of the contact part according to FIG. 4*a* from below.
FIG. 4*c* shows a view of the contact part according to FIG. 4*a* from the side.
FIG. 4*d* shows a view of the contact part according to FIG. 4*a* from above.
FIG. 4*e* shows a perspective view of the contact part according to FIG. 4*a* from above.
FIG. 4*f* shows a perspective view of the contact part according to FIG. 4*a* from below.
Figure 4C:
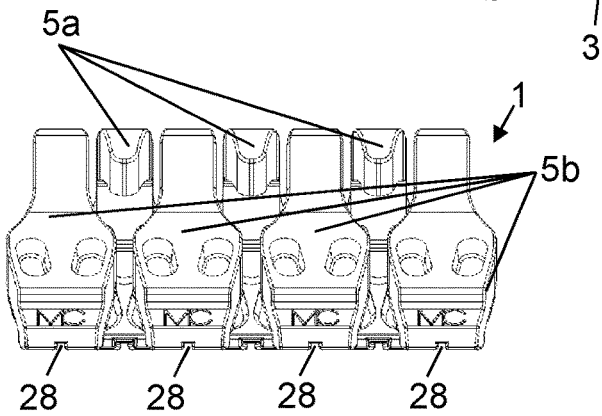
Figure 4D:
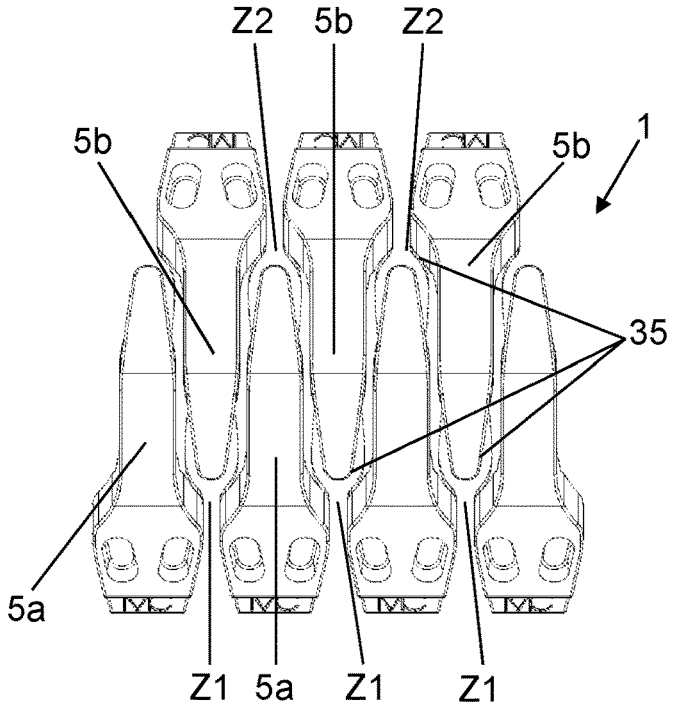
Figure 4E:
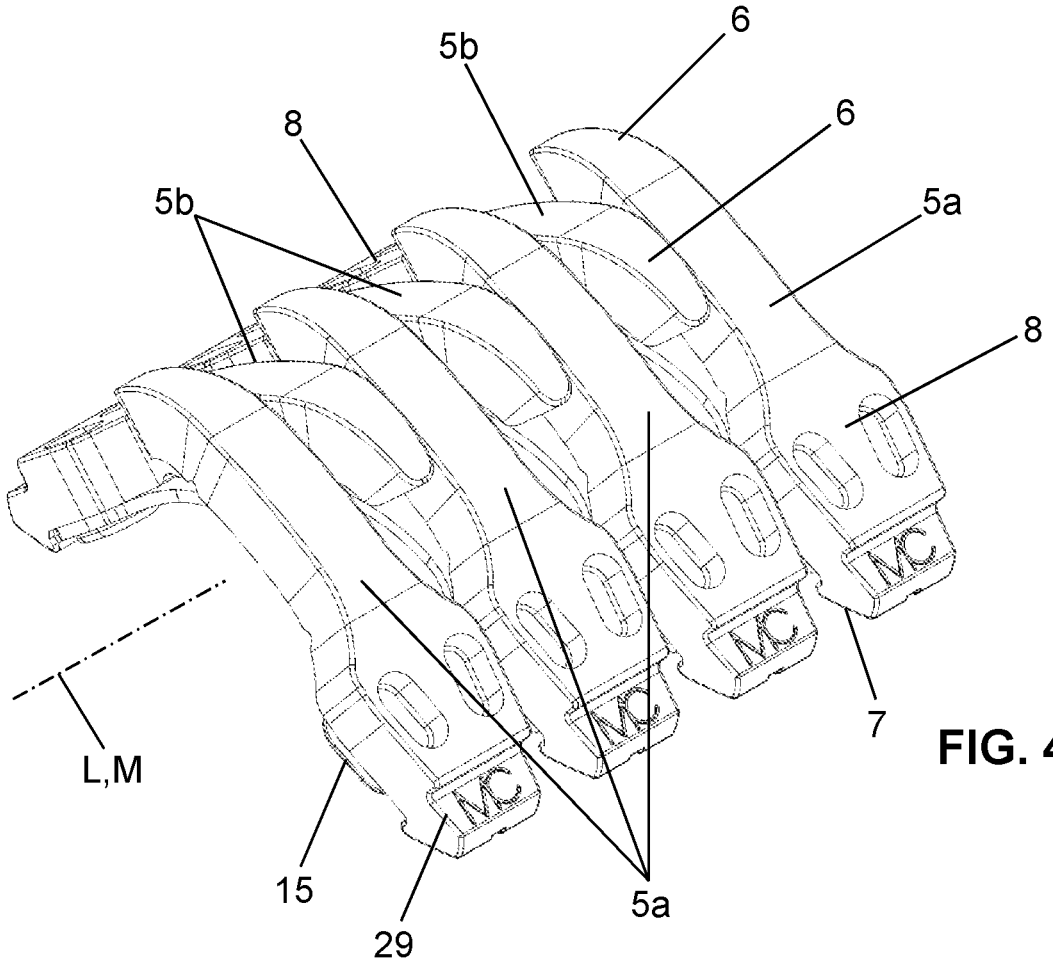
Figure 4F:
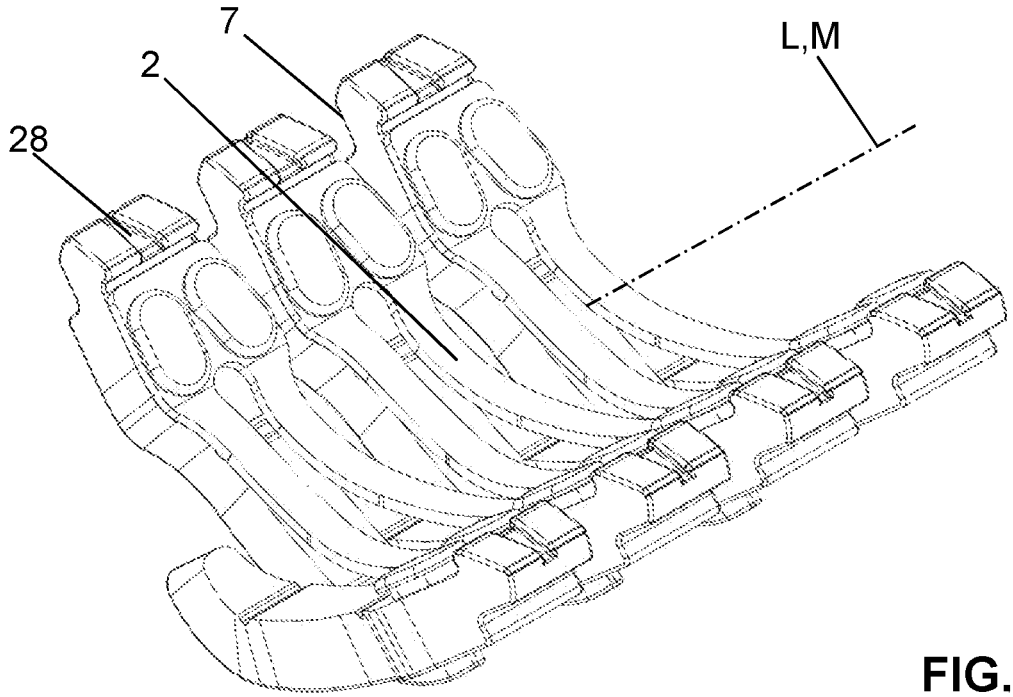
Figure 5A:
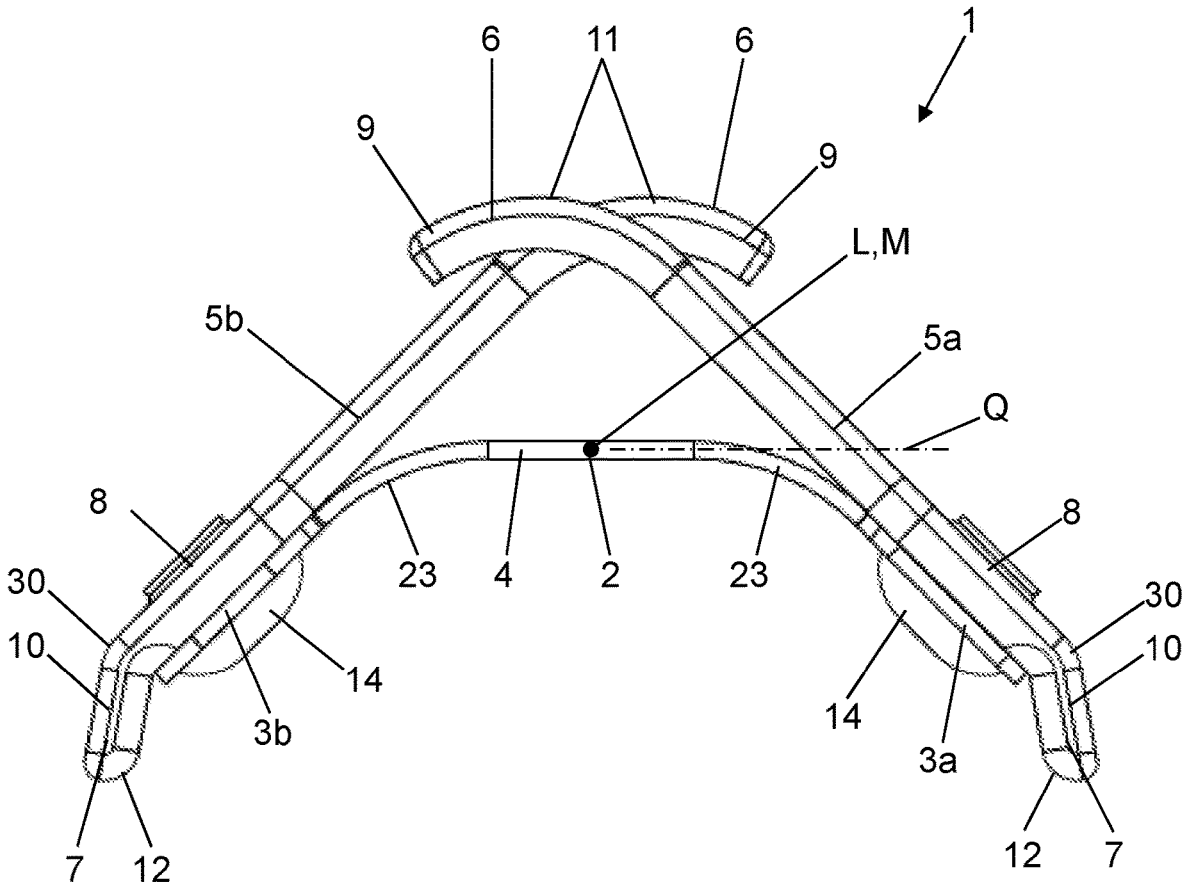
FIG. 5*a* shows a front view of a contact part according to a second embodiment of the present invention.
Figure 5B:
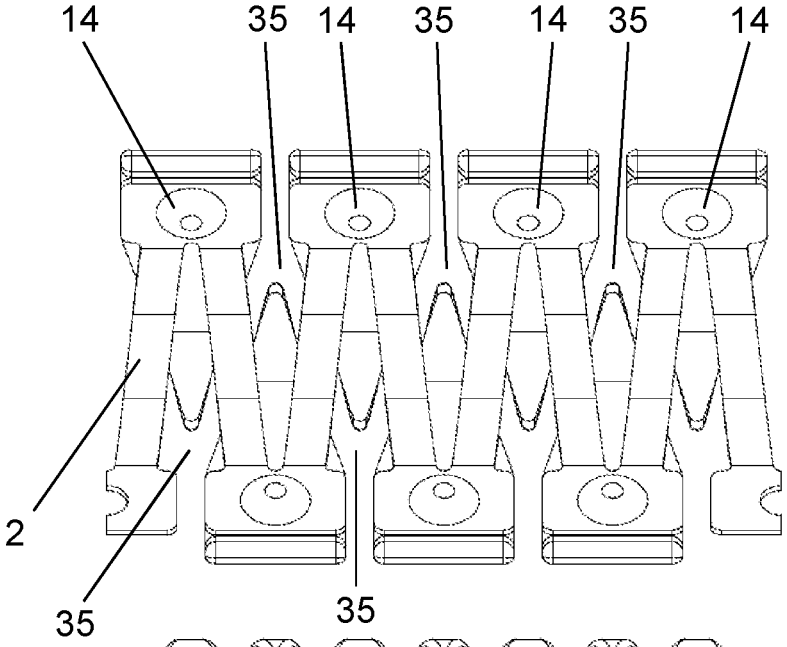
FIG. 5*b* shows a view of the contact part according to FIG. 5*a* from below.
Figure 5C:
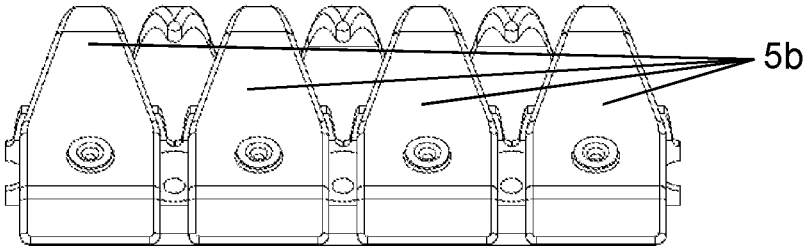
FIG. 5*c* shows a view of the contact part according to FIG. 5*a* from the side.
Figure 5D:
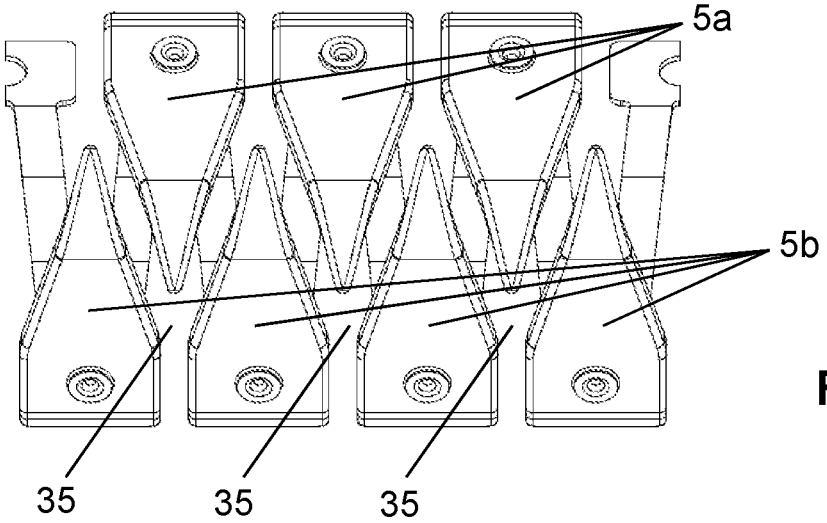
FIG. 5*d* shows a view of the contact part according to FIG. 5*a* from above.
Figure 5E:
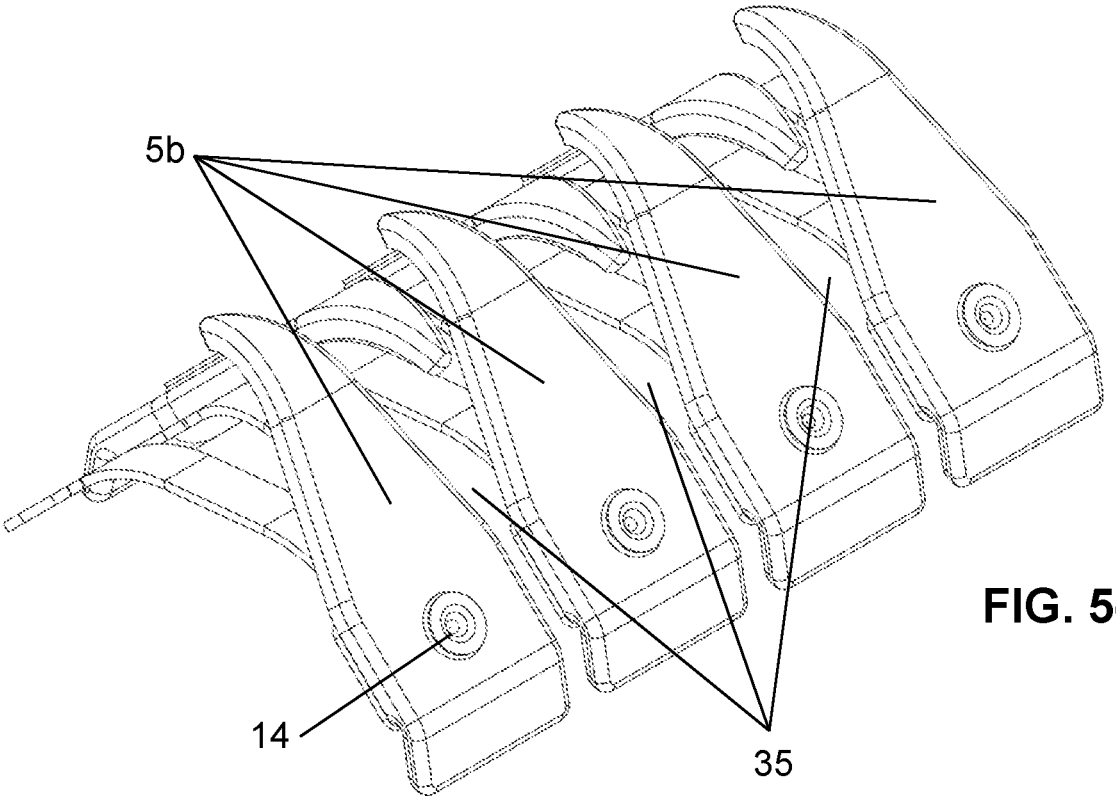
FIG. 5*e* shows a perspective view of the contact part according to FIG. 5*a* from above.
Figure 5F:
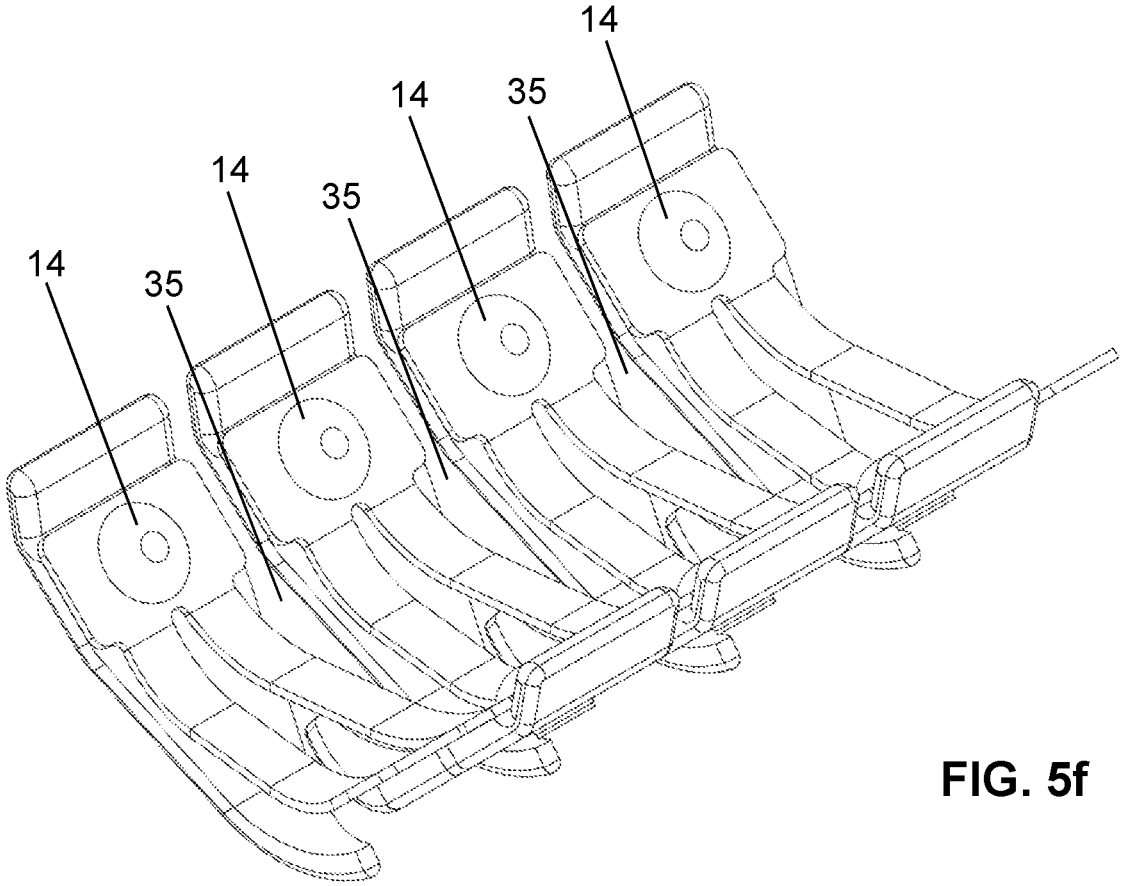
FIG. 5*f* shows a perspective view of the contact part according to FIG. 5*a* from below.
Figure 6A:
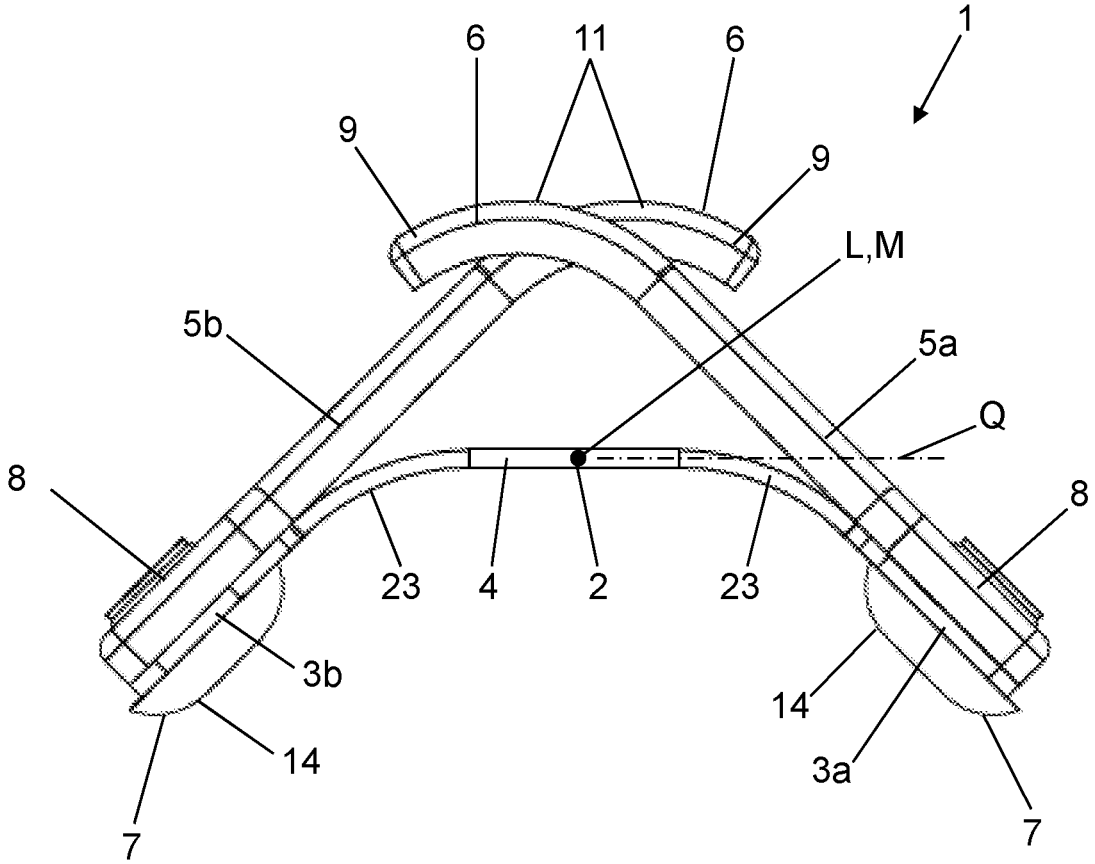
FIG. 6*a* shows a front view of a contact part according to a third embodiment of the present invention.
Figure 6B:
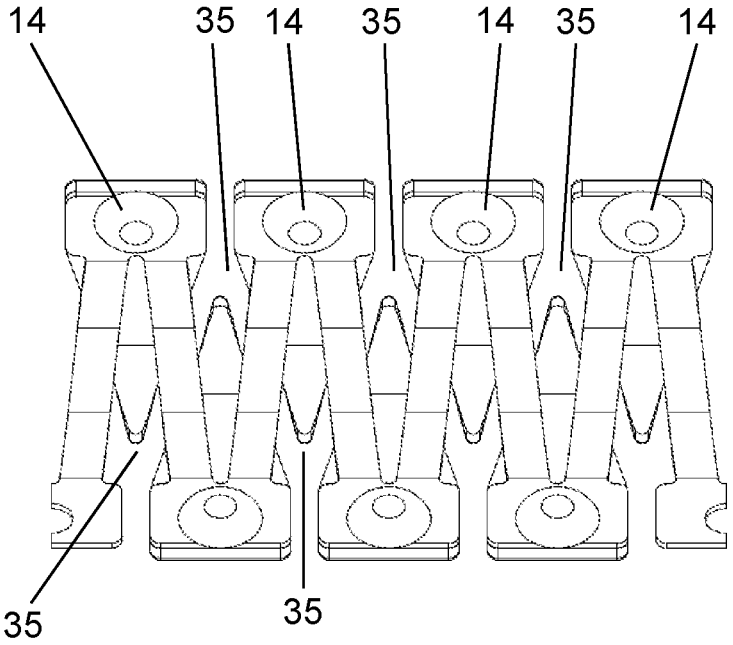
FIG. 6*b* shows a view of the contact part according to FIG. 6*a* from below.
Figure 6C:
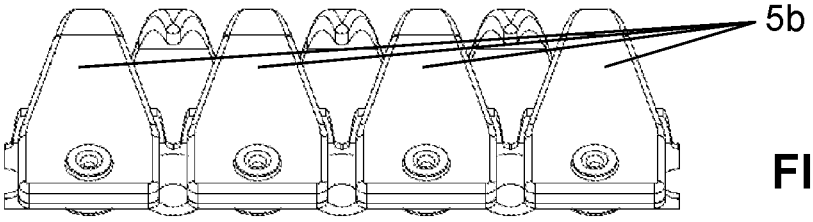
FIG. 6*c* shows a view of the contact part according to FIG. 6*a* from the side.
Figure 6D:
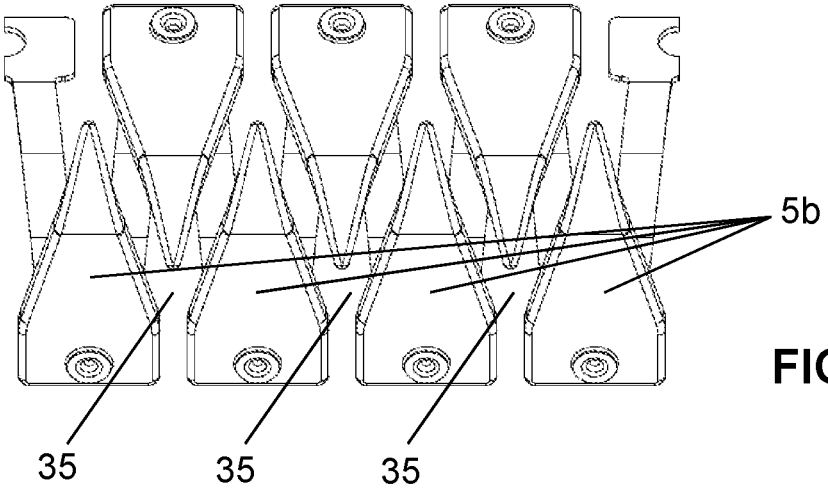
FIG. 6*d* shows a view of the contact part according to FIG. 6*a* from above.
Figure 6E:
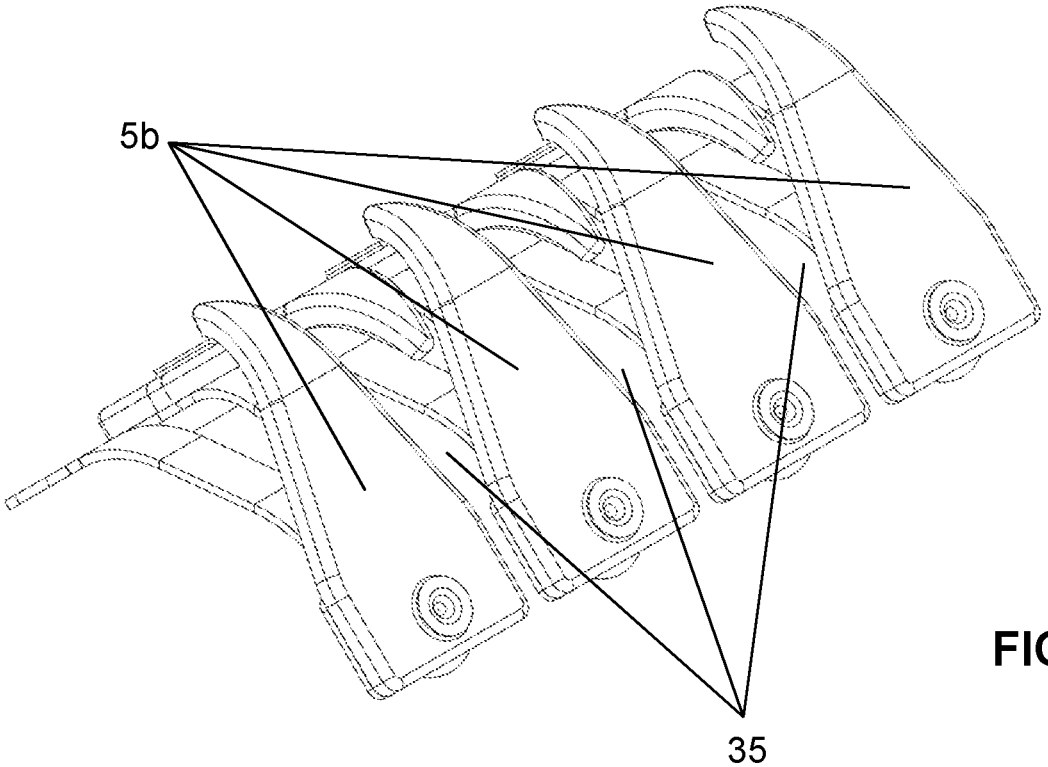
FIG. 6*e* shows a perspective view of the contact part according to FIG. 6*a* from above.
Figure 6F:
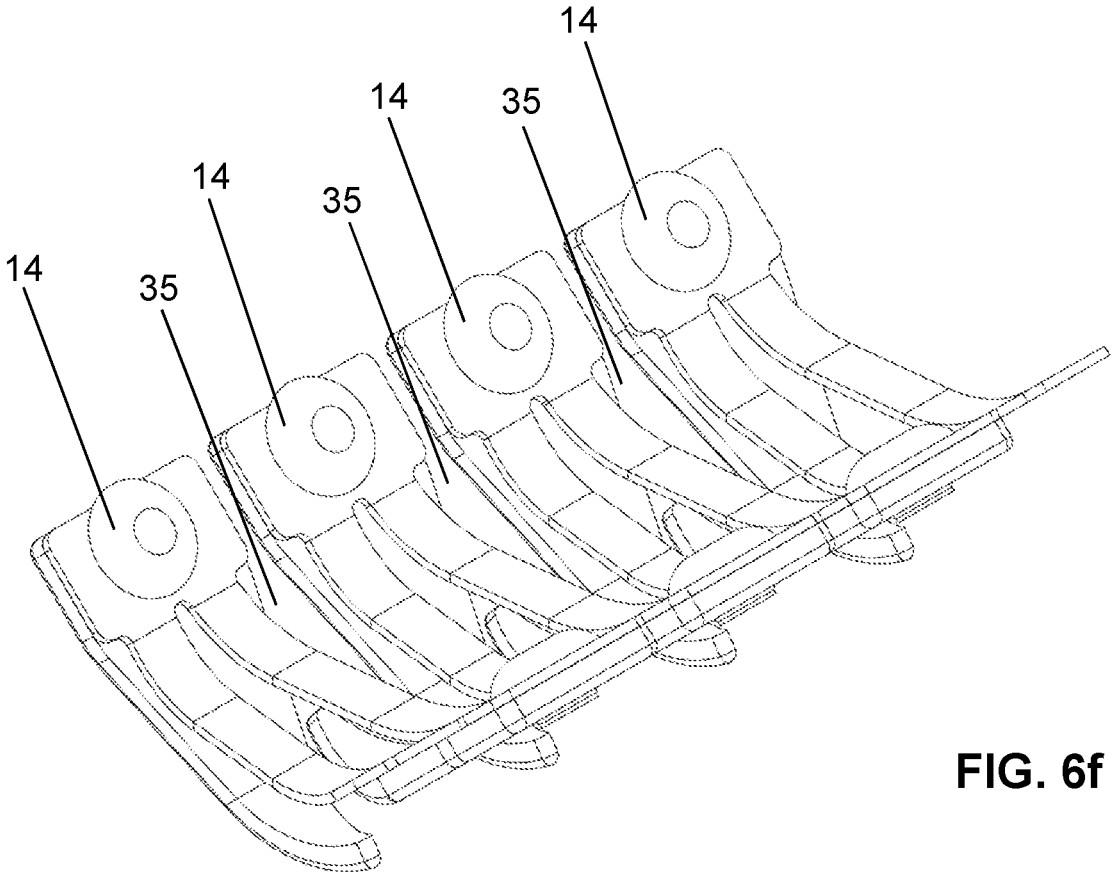
FIG. 6*f* shows a perspective view of the contact part according to FIG. 6*a* from below.

In FIG. 3, the carrier strip 2, to which the contact parts 5 are fastened, is shown in detail.

The carrier strip 2 is designed in such a way that, when a force F is applied to the carrier strip 2 in the longitudinal direction L, said carrier strip is deformed. The carrier strip 2 is therefore designed in a manner such that its length can be changed. As an alternative, the carrier strip can also be of rigid design in its longitudinal direction. Therefore, in the alternative, the length of the carrier strip does not change.

Here, the carrier strip 2 is formed from a flat strip, the thickness of said flat strip being several times smaller than the width of said flat strip.

In the embodiment shown, the carrier strip 2 comprises a plurality of fastening spots 3. In this case, the fastening spots 3, as seen in the longitudinal direction 1, are arranged at a distance A in relation to one another. Two rows of fastening spots 3 are provided in the embodiment shown. One row comprises first fastening spots 3*a* that are arranged one behind the other in the longitudinal direction L, and the other row comprises second fastening spots 3*b* that are likewise arranged one behind the other in the longitudinal direction L. The two rows therefore extend in the longitudinal direction L, wherein the rows are at a distance in relation to one another in a transverse direction Q that runs transverse in relation to the longitudinal direction. The distance between the fastening spots 3 is identical in both rows. However, the first fastening spots 3*a* are arranged offset by an offset B in relation to the second fastening spots 3*b* in the longitudinal direction L. The offset B can correspond, for example, to half the distance A. Here, the fastening spots 3 lie in the region of the outer edge 13 of the carrier strip 2. In an alternative, the carrier strip 2 can have a substantially constant cross section over its length in the longitudinal direction and is substantially rigid as seen in the longitudinal direction.

The figures show a symmetrical arrangement of the fastening spots 3 with respect to the longitudinal direction L. An asymmetrical arrangement is likewise conceivable.

A line M is situated between the row of first fastening spots 3*a* and the row of second fastening spots 3*b*, which likewise extends in the longitudinal direction L. In this case, the line M can be a center line M. The first fastening spots 3*a* and the second fastening spots 3*b* are at a transverse distance C in relation to the line M with respect to the transverse direction Q.

The contact parts 5 are fastened to the carrier strip 2 at the fastening spots 3.

FIGS. 4*a* to 4*f* show a first embodiment, FIGS. 5*a* to 5*f* show a second embodiment, FIGS. 6*a* to 6*f* show a third embodiment, FIGS. 7*a* to 7*f* show a fourth embodiment, and FIGS. 8*a* to 8*f* show a fifth embodiment of a contact element 1 according to the invention.

The individual embodiments will now be explained in greater detail in the text that follows, wherein firstly the features that are the same in all embodiments and then features that are different will be explained.

FIGS. 4*a* to 8*f* clearly show that the contact parts 5 are fixedly connected to the fastening spots 3 of the carrier strip 2.

According to all of the embodiments, the contact parts 5 each comprise a first contact section 6 for making contact with one of the two contact pieces K1, K2, a second contact section 7 for making contact with the other of the two contact pieces K2, K1, and also a fastening section 8 for fastening the contact part 5 to a fastening spots 3 of the carrier strip 2.

In all of the embodiments, in each case one first contact part 5*a*, by way of its fastening section 8, is connected to a first fastening spot 3*a*. A second contact part 5*b*, in each case by way of its fastening section 8, is connected to a second fastening spot 3*b*. The first contact part 5*a*; which is connected to the first fastening spot 3*a*, is oriented, by way of its first contact section 6, toward the second contact part 5*b*, which is connected to the second fastening spot 3*b*. The first contact section 6 therefore protrudes toward the second contact part 5*b*. Similarly, the second contact part 5*b*, which is connected to the second fastening spot 3*b*, is oriented, by way of its first contact section 6, toward the first contact part 5*a*, which is connected to the first fastening spot 3*a*. In this case, the contact parts 5*a*, 5*b* are arranged in such a way that the respective first contact sections 6 extend from the fastening spot 3*a*, 3*b* beyond the line M that extends centrally between the two fastening sections 3*a*, 3*b* in the longitudinal direction L. That is to say, the first contact sections 6 of the respective contact parts are situated at least partially on the other side with respect to the line M.

The contact parts 5, 5*a*, 5*b* are situated in relation to the carrier strip 2 in such a way that the contact parts 5, 5*a*, 5*b* can be pivoted about a pivot line S that is situated parallel in relation to the line M. This in particular is clearly shown in FIGS. 4*a*, 5*a*, 6*a*, 7*a* and 8*a*.

The pivot line S is oriented at a right angle in relation to the surface of the drawing sheet here. When contact is made by the first contact piece K1, the contact part 5 is pivoted, as illustrated in FIGS. 1 and 2 and the pivot movement according to arrow S'.

In addition to the pivoting movement S', the contact part 5 can also move relative on the contact face 18, 19 of the corresponding contact piece K1, K2 during the pivoting movement about the pivot line S. For this, the contact part 5 moves, together with the second contact section 7, relative to the second contact piece K2. This movement runs transverse to the pivot line S and is provided with reference symbol V.

FIGS. 4*a*, 5*a*, 6*a*, 7*a* and 8*a* further clearly show that the first contact part 5*a*, as seen from its fastening spot 3*a*, extends in such a way that the first contact section 6, as seen transverse to the longitudinal direction, extends beyond a second contact part 5*b*. The excess length is indicated by the arrow D. In doing so, the first contact part 5*a* extends beyond the second contact part 5*b* in such a way that, in the event of a contact movement from the side of the second contact part 5*b*, contact is first made with the first contact part 5*a* by the corresponding contact piece. Looking at FIGS. 4*a*, 5*a*, 6*a*, 7*a* and 8*a*, this means, when a contact piece is pushed toward the contact element 1 in the direction of arrow P', the contact piece first comes into contact with the first contact part 5*a*, before the contact piece comes into contact with the second contact part 5*b*.

The function of the contact element can be optimized due to the excess. For example, the maximum insertion force can be optimized in respect of the required installation space.

In other words, the first contact section 6 of the first contact part 5*a* protrudes beyond the top side 22 of the second contact part 5*b*. It goes without saying that the second contact part 5*b* is also arranged in this manner. Namely, the first contact section 6 of the second contact part 5*b* is arranged in such a way that it protrudes beyond the top side 22 of the first contact part 5*a*, specifically in such a way that, in the event of a contact movement from the side of the first contact part 5*a*, contact is first made with the second contact part 5*b* by the contact piece. This movement is symbolized by the arrow P in FIG. 4*a*.

S FIGS. 4*a*, 5*a*, 6*a*, 7*a* and 8*a* additionally show that the webs 4 are designed such that they are bent once or bent several times about a line M that is situated between the fastening spots 3*a*, 3*b*, so that the surface 24 of the fastening spots 3*a*, which are arranged on one side of the line M, are situated in a manner inclined at an angle in relation to the surface 24 of the fastening spots 3*b* that are arranged on the other side of the line M. The bending spot is in each case provided with the reference symbol 23 and the angle between the first fastening spots 3*a* and the second fastening spots 3*b* is indicated by β.

FIGS. 4*b*, 5*b*, 6*b*, 7*b* and 8*b* additionally show that in each case one second contact part 5*b* extends into the intermediate space Z1, Z2 which is situated between two adjacent first contact parts 5*a*. A first contact part 5*a* extends between two second contact parts 5*b*, which are arranged adjacent to one another, into the intermediate space Z2. An interleaved structure is therefore produced.

In all of the embodiments according to FIGS. 4*a* to 8*f*, the first contact section 6 of the contact part 5, 5*a*, 5*b* forms a free end 9 that protrudes from the carrier strip 2. The free end 9 is therefore not situated on the carrier strip 2, but rather extends away from the carrier strip 2 from the fastening section 8.

In the deflected state, the free end 9 can protrude through the carrier strip 2 through a recess 35 in the carrier strip 2. The recess 35 is preferably provided by the intermediate region between two webs 4.

The fastening section 8 abuts flat against the carrier strip 2.

Depending on the type of fastening of the contact part 5, 5*a*, 5*b*, the second contact section 7 is likewise a free end or abuts on the bottom side 25 of the carrier strip 2. This will be discussed further below in the context of the fastening of the contact parts 5, 5*a*, 5*b*.

In the embodiment according to FIGS. 4*a* to 4*f*, the second contact section 7 of the contact part 5, 5*a*, 5*b* is arranged in relation to the carrier strip 2 in such a way that the carrier strip 2 is not connected to the contact piece K2 in the contact position. The second contact section 7 is designed as a kind of raised portion 29 and is situated at a distance from the bottom side of the carrier strip 2.

In all of the embodiments according to FIGS. 4*a* to 8*f*, the contact part 5 is designed with a rounded portion 11 in the first contact section 6. The rounded portion 11 relates, in particular, to the top side 22 of the contact part in the first contact section 6, because the contacting with the respective contact faces K1, K2 is also made by means of the top side 22. Depending on the design, the bottom side 26 of the contact part 5, 5*a*, 5*b* can also be rounded. The rounded portion 11 extends around a rounded portion axis R11 with a constant or changing rounded portion radius. The rounded portion axis R11 preferably extends parallel in relation to the longitudinal direction L.

In the embodiments of FIGS. 4*a*-4*f*, 5*a*-5*f*, 7*a*-7*f* and 8*a*-8*f*, the second contact section 7 of the contact part 5, 5*a*, 5*b* is also designed in a rounded manner with a rounded portion 12. The rounded portion 12 extends around a rounded portion axis R12 with a constant or changing rounded portion radius. The rounded portion axis R12 preferably extends parallel in relation to the longitudinal direction L.

In the third embodiment according to FIGS. 6*a*-6*f*, the second contact section 7 is not provided directly by the contact part 5, 5*a*, 5*b*, but rather by a rivet 14, this being discussed yet further in the text that follows. In this case, the surface of the rivet 14 is designed with the rounded portion 12.

In the embodiments of FIGS. 4*a* to 8*f*, the second contact section 7 is situated in the region of the fastening section 8. That is to say, the second contact section 7 and the fastening section 8 are situated physically close to one another. The contact part 5, 5*a*. 5*b* is designed with a rounded portion 12 in the second contact section 7, which rounded portion 12 extends around a rounded portion axis R12 that runs parallel in relation to the longitudinal direction L, wherein the rounded portion axis R12 and the pivot line S run in a substantially collinear manner in relation to one another.

Figure 7A:
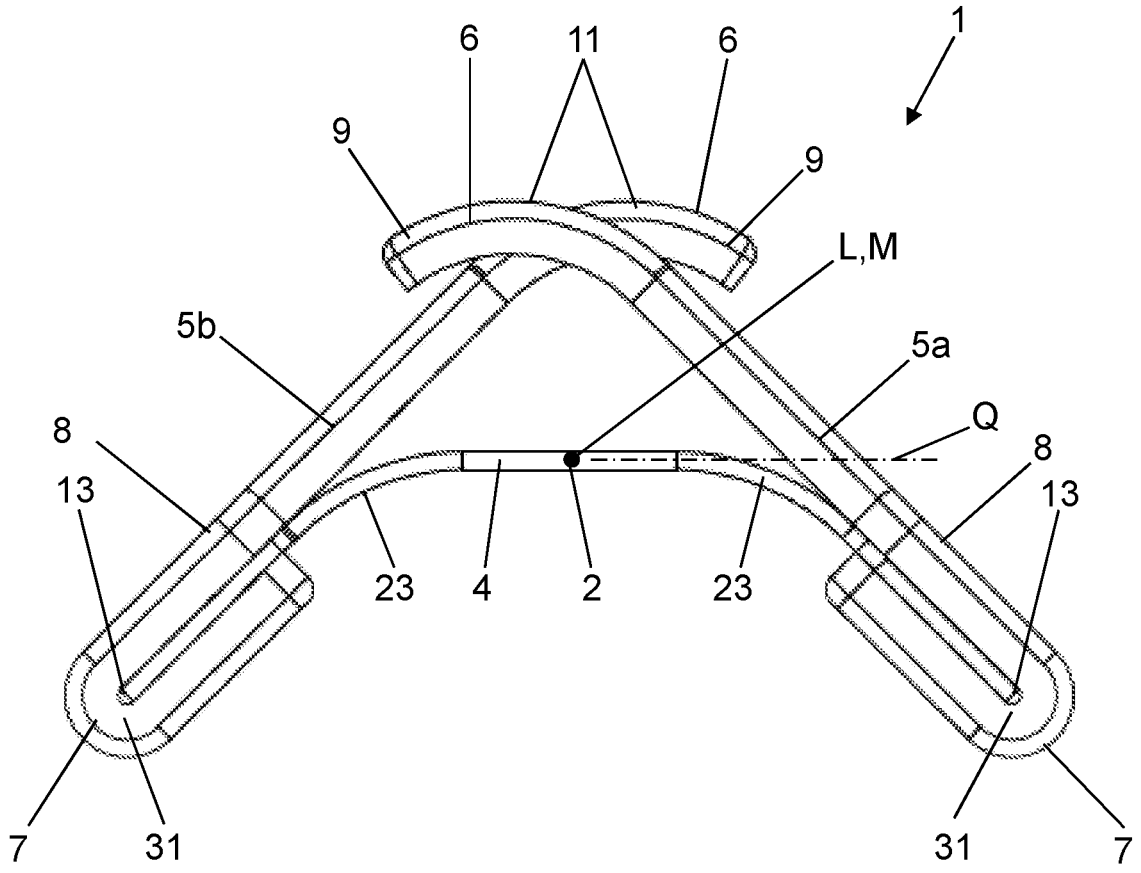
FIG. 7*a* shows a front view of a contact part according to a fourth embodiment of the present invention.
Figure 7B:
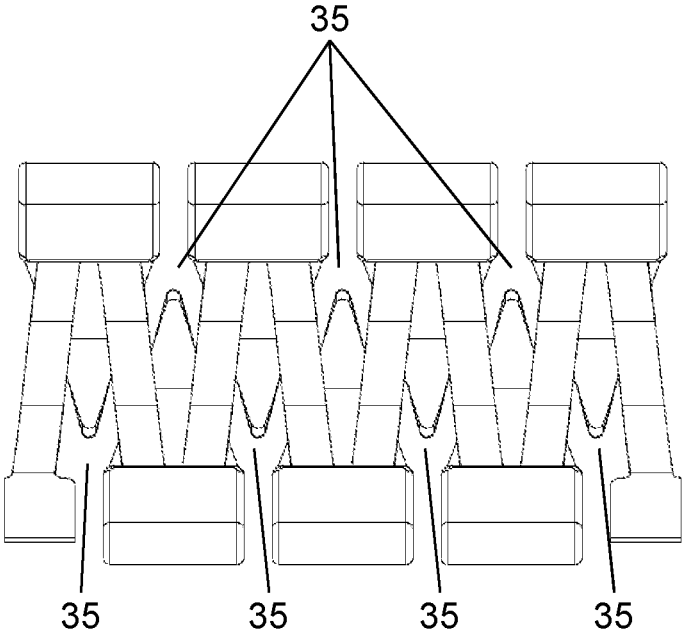
FIG. 7*b* shows a view of the contact part according to FIG. 7*a* from below.
Figure 7C:
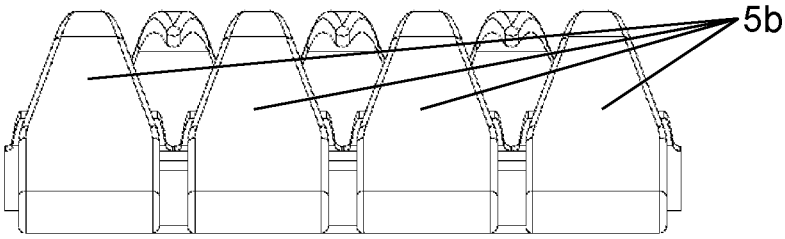
FIG. 7*c* shows a view of the contact part according to FIG. 7*a* from the side.
Figure 7D:
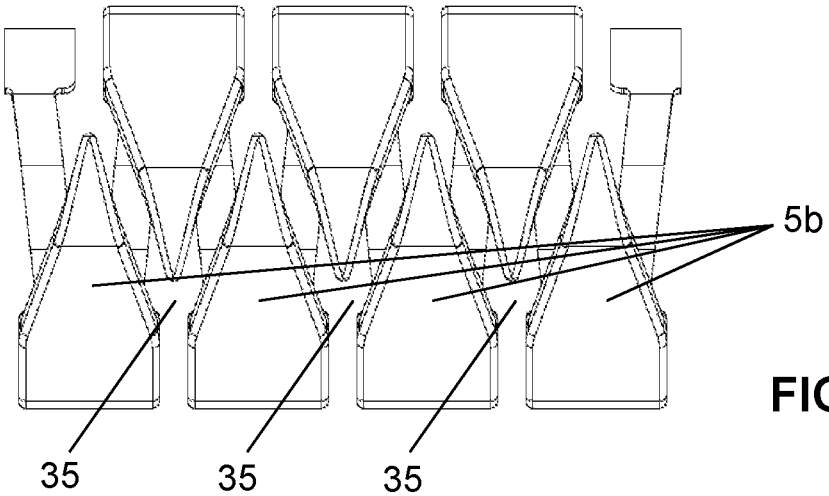
FIG. 7*d* shows a view of the contact part according to FIG. 7*a* from above.
Figure 7E:
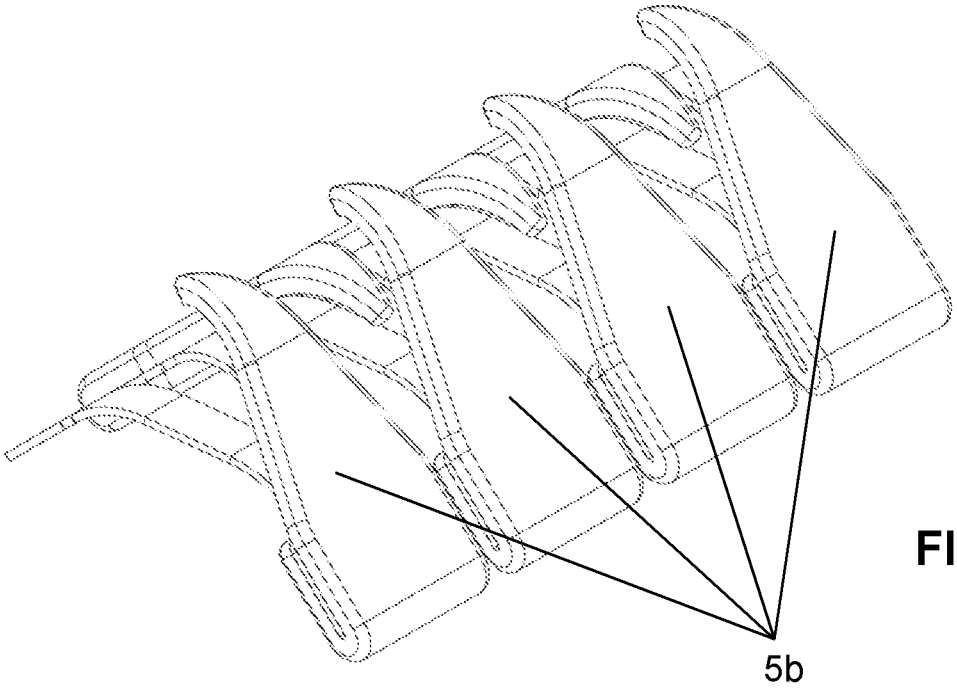
FIG. 7*e* shows a perspective view of the contact part according to FIG. 7*a* from above.
Figure 7F:
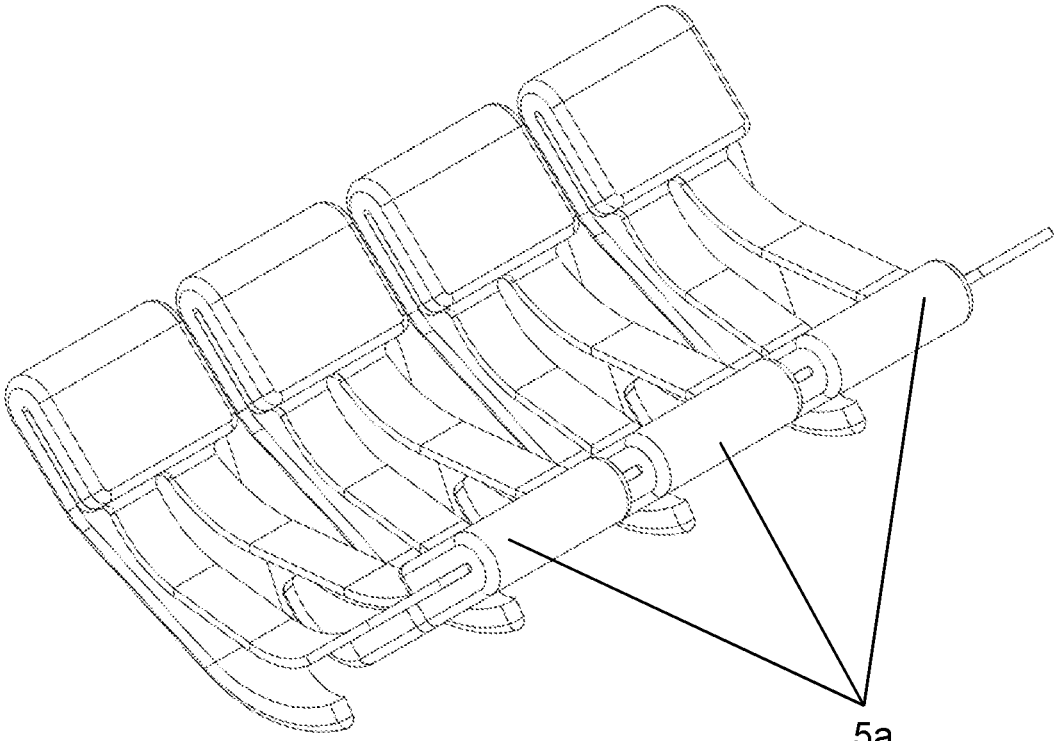
FIG. 7*f* shows a perspective view of the contact part according to FIG. 7*a* from below.
Figure 8A:
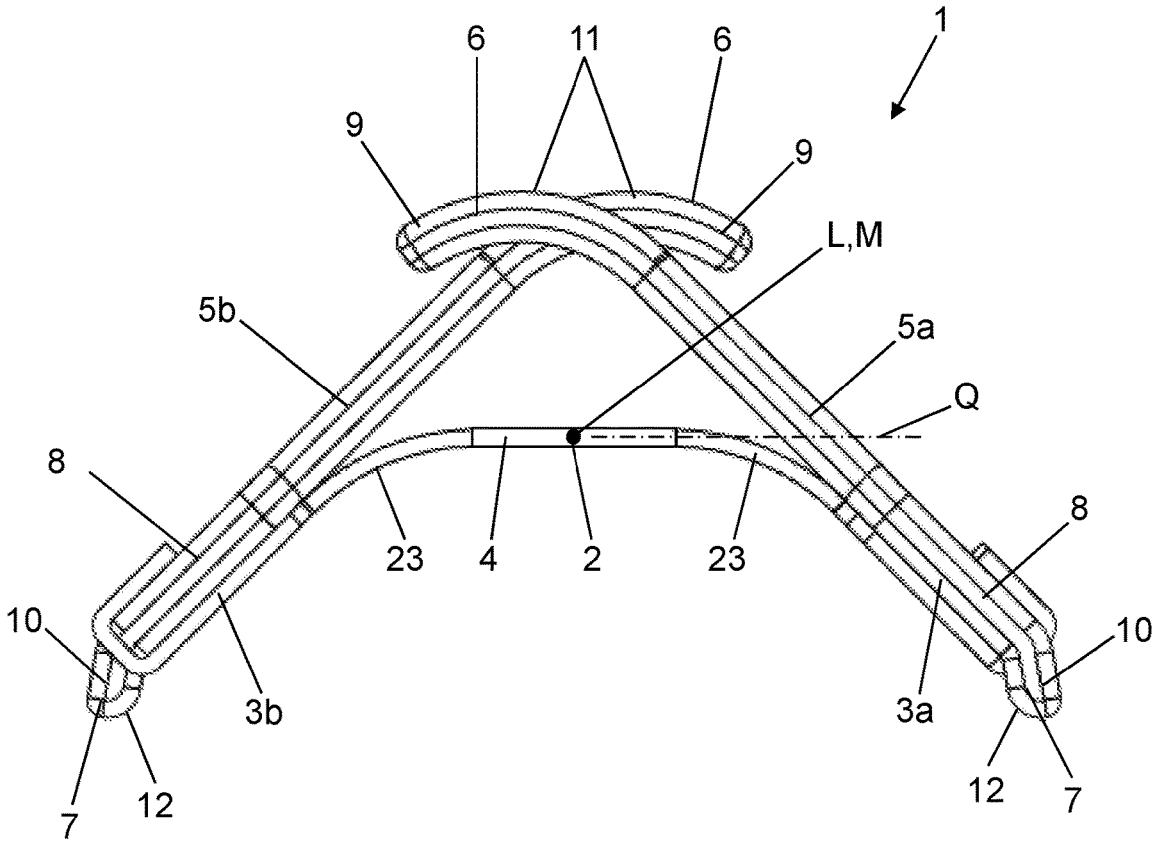
FIG. 8*a* shows a front view of a contact part according to a fifth embodiment of the present invention.
Figure 8B:
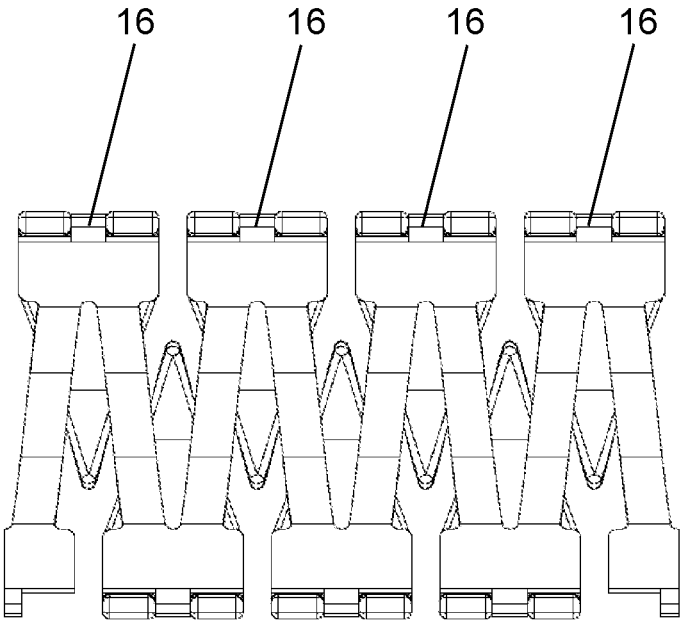
FIG. 8*b* shows a view of the contact part according to FIG. 8*a* from below.
Figure 8C:
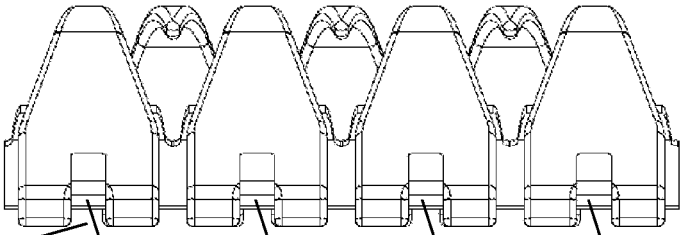
FIG. 8*c* shows a view of the contact part according to FIG. 8*a* from the side.
Figure 8D:
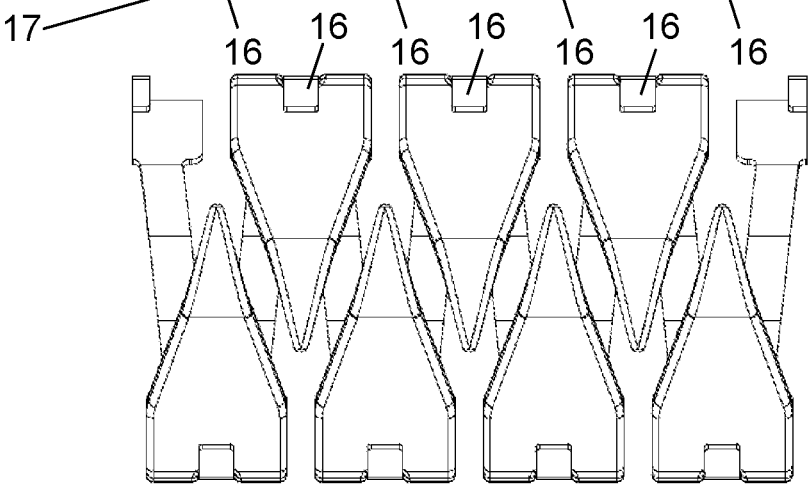
FIG. 8*d* shows a view of the contact part according to FIG. 8*a* from above.
Figure 8E:
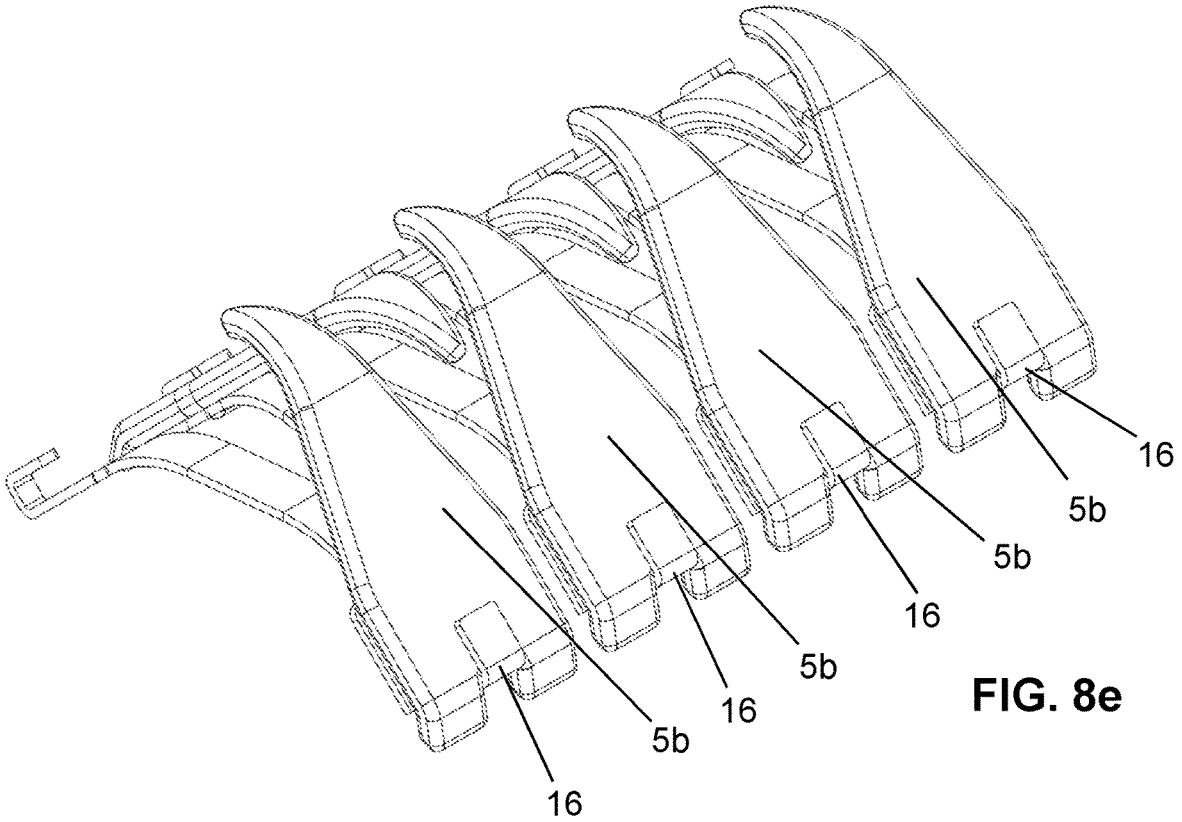
FIG. 8*e* shows a perspective view of the contact part according to FIG. 8*a* from above.
Figure 8F:
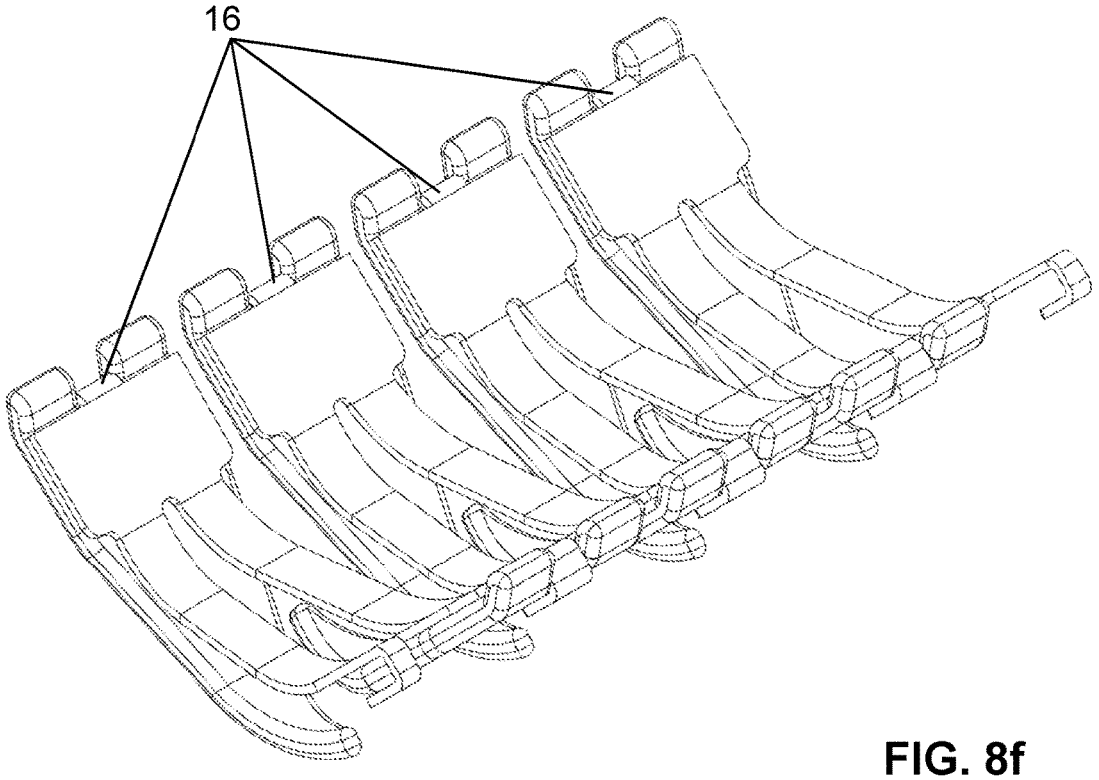
FIG. 8*f* shows a perspective view of the contact part according to FIG. 8*a* from below.

In the embodiments of FIGS. 7*a* and 8*a*, the second contact section 7 surrounds the carrier strip in the region of its outer edge 13.

In all of the embodiments, the rounded portion radius R11 of the rounded portion 11 of the first contact section 6 can be different from the rounded portion radius R12 of the rounded portion 12 of the second contact section 7. The rounded portion radii R11, R12 can also be the same.

In all of the embodiments, the cross section of the contact part 5, 5*a*, 5*b* in the region of the fastening section 8 is larger than in the region of the first contact section 6. The first contact section 6 is therefore designed in a tapered manner in relation to the fastening section 8. The change in cross section can have different geometries.

In the embodiments of FIGS. 4*a*-4*f* and 8*a*-8*f*, the cross section of the contact part 5, 5*a*, 5*b* as seen in the region of the fastening section 8 is larger than the cross section of the contact part 5, 5*a*, 5*b* in the region of the second contact section 7. The second contact section 7 is therefore designed in a tapered manner in relation to the fastening section 8. The change in cross section can have different geometries. However, the degree of taper in the second contact section 7 is preferably smaller than in the first contact section 6.

In the embodiments of FIGS. 5*a*-5*f*, 6*a*-6*f* and 7*a*-7*f*, the cross section of the contact part 5, 5*a*, 5*b* in the region of the fastening section 8 is substantially equal to the cross section in the region of the second contact section 7.

In the first embodiment according to FIGS. 4*a* to 4*f*, the contact part 5, 5*a*, 5*b* is connected to the carrier strip 2 by way of at least one rivet 15. At least one rivet 15 is formed in one piece with the contact part 5, 5*a*, 5*b*. The contact part 3 and the rivet 15 therefore form a one-piece structure. The rivet 15 is then plastically deformed in the region of the bottom side 25 of the carrier strip, so that a rivet head 27 is formed, with which rivet head the carrier strip 2 is clamped to the contact part 5, 5*a*, 5*b*. The rivet 15 protrudes through the carrier strip 2 through a rivet opening 33. The rivet 15 and also the rivet opening 33 have substantially the same cross section and are here of oval design.

In the shown embodiment according to FIGS. 4*a* to 4*f*, four rivets 15 are provided for each contact part 5, 5*a*, 5*b*. In other variants of the first embodiment, the number of rivets 15 can also be larger than or less than four.

The rivets 15 according to the first embodiment are preferably produced by a stamping process, wherein a stamping tool plastically deforms the fastening section from the top side 22 and in this way presses out the rivets from the bottom side 26 of the contact element.

The fastening spots 3 have apertures for receiving the rivets 15. The number of apertures and the position thereof is matched to the number and to the position of the rivets 15. The apertures in the carrier strip are produced, for example, by a punching process.

In the first embodiment, the second contact section 7 has an optional indentation 28 that, as seen centrally through the second contact section 7 and transverse in relation to the longitudinal direction L, extends into the second contact section 7. A defined division of the contact faces can be achieved by way of the indentation 28, as a result of which the contact resistance is definable in a more precise manner.

The contact part 5 further comprises a raised portion 29 in the region of the outer edge 13 of the fastening spot 3. The second contact section 7 then adjoins raised portion 29. Owing to the raised portion 29, the fastening section 8 is situated in a manner offset to the rear from the contact section 7, so that the fastening spot 3 and the rivet head 27 are likewise offset from the contact section 7 in such a way that they do not have a negative influence on the contacting process.

In the second embodiment according to FIGS. 5*a* to 5*f*, the contact part 5, 5*a*, 5*b* is connected to the carrier strip 2 by way of at least one rivet 14.

The rivet 14 in this embodiment is designed separately from the contact part 5, 5*a*, 5*b*. The rivet 14 is routed through an aperture in the second contact section 7 and through an aperture in the fastening spot 3. The contact part 5, 5*a*, 5*b* is clamped to the fastening spot 3 by way of the rivet 14.

In the embodiment shown, only one rivet 14 is shown. The provision of several rivets 14, as shown for example in figures FIGS. 4*a*-4*f*, would also be conceivable.

In the second embodiment, the second contact section 7 adjoins the fastening section 8 opposite the first contact section 6. In this case, the second contact section 7 is designed in a manner bent from the fastening section 8 by means of a bend spot 30 and runs in a manner inclined at an angle in relation to the fastening section.

In this embodiment, the first contact section 6 is designed as a rounded tip with the above-described rounded portion, wherein the tip tapers toward the free end 9.

The fastening by way of the at least one rivet 14 could be assisted by way of a welded or soldered connection, in addition to the mechanical fastening. The rivet 14 could thus be welded.

In the third embodiment according to FIGS. 6*a* to 6*f*, the contact part 5, 5*a*, 5*b* is connected to the carrier strip 2 by way of at least one rivet 14.

The rivet 14 of this embodiment is designed separately from the contact part 5, 5*a*, 5*b*. The rivet 14 is routed through an aperture in the second contact section 7 and through an aperture in the fastening spot 3. The contact part 5, 5*a*, 5*b* is clamped to the fastening spot 3 by way of the rivet 14.

In the embodiment shown, only one rivet 14 is displayed. The provision of several rivets 14, as for example shown in figures 4*a*-4*f*, would also be conceivable.

According to the third embodiment, the rivet 14 is provided from an electrically conductive material, and the rivet head 27 on the bottom side 26 of the carrier strip 2 provides the second contact section. The rivet 14 is in electrical contact with contact part 5, 5*a*, 5*b*.

In the embodiment shown, the rivet head 27 protrudes beyond the outer edge 13 of the fastening spot 3, so that good contacting with the contact face of the second contact piece is achieved.

The rivet head 27 has the above-described rounded portion 12.

In a further embodiment, which substantially corresponds to the combination of the first and the third embodiment, the rivet is formed in one piece with the contact part, as in the case of the first embodiment, and the rivet head is then reshaped, according to the third embodiment, so that the rivet head can provide said second contact section. This further embodiment is not illustrated in the figures.

In this embodiment, the first contact section 6 is designed as a rounded tip with the above-described rounded portion, wherein the tip tapers toward the free end 9.

The fastening by way of the at least one rivet 14 could be assisted by way of a welded or soldered connection, in addition to the mechanical fastening. The rivet 14 could therefore be welded or soldered.

In the fourth embodiment according to FIGS. 7*a* to 7*f*, the fastening section 8 at least partially surrounds the fastening spot 3. In the embodiment shown, the fastening section 8 surrounds the fastening spot on its top side as well as on its bottom side and the outer edge 13. When the contact part 3 is mounted, the fastening section 8 is plastically reshaped and thereby clamped to the fastening spot. The mechanical clamping can be assisted by an additional soldered or welded connection.

The fastening section preferably substantially completely surrounds the top side resp. the bottom side of the fastening spot. It would also be conceivable that the fastening section only partially surrounds the top side and/or the bottom side.

The clamping can also be called crimping or a crimped connection. In the figures, the crimping is provided with reference symbol 31.

That part of the fastening section 8 that extends around the outer edge 13 at the same time serves as a second contact section 7 and is accordingly designed with a rounded portion 12 on its outer side.

In the fifth embodiment according to FIGS. 8*a* to 8*f*, the contact part 5, 5*a*, 5*b* is fastened to the fastening spot 3 by way of a clip element 16. In the embodiment shown, the clip element 16 is formed on the fastening spot 3 and extends away from the outer edge 13 of the fastening spot 3 transverse in relation to the longitudinal direction L. The clip element 16 is reshaped and extends to the top side 22 of the contact part 5, 5*a*, 5*b* in the region of the fastening section 8 and thereby clamps the contact part 5, 5*a*, 5*b* to the fastening spot 3.

As an alternative, the clip element 16 can also be an element that is separate from the contact part or from the fastening spot 3.

The clip element 16 preferably extends through a slot 17 that extends into the second contact section 7. This ensures that the clip element does not have a negative influence on the contacting between the second contact section 7 and the second contact piece K2. In other words, the contact section 7 extends away from the fastening section 8 as a second free end.

The mechanical clamping by the clip elements 16 can be assisted by an additional soldered or welded connection.

FIGS. 9*a* to 9*d* show a schematic view of a first installation situation of a contact element 1. In this case, the contact element 1 can be designed within in accordance with the present invention, in particular according to the preceding embodiments.

Here, the longitudinal direction of the carrier strip 2 resp. the line M extend around a center axis X. FIGS. 9*a* to 9*d* substantially show the installation situation in a socket, wherein the second contact sections 7 are then situated in a groove in a socket.

Figure 9A:
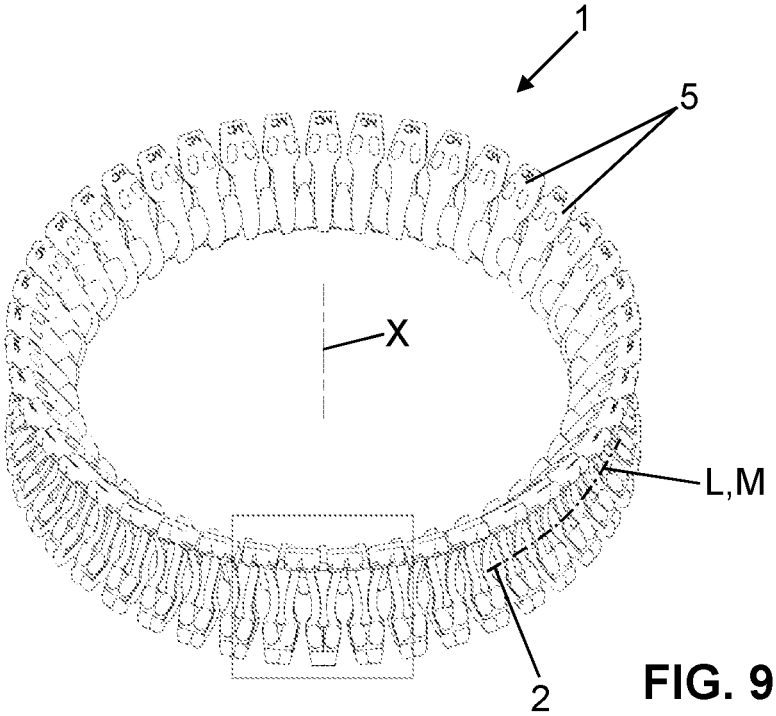
FIG. 9*a* shows a schematic view of a contact part according to the invention for arranging in a circumferential groove in a socket.
Figure 9B:
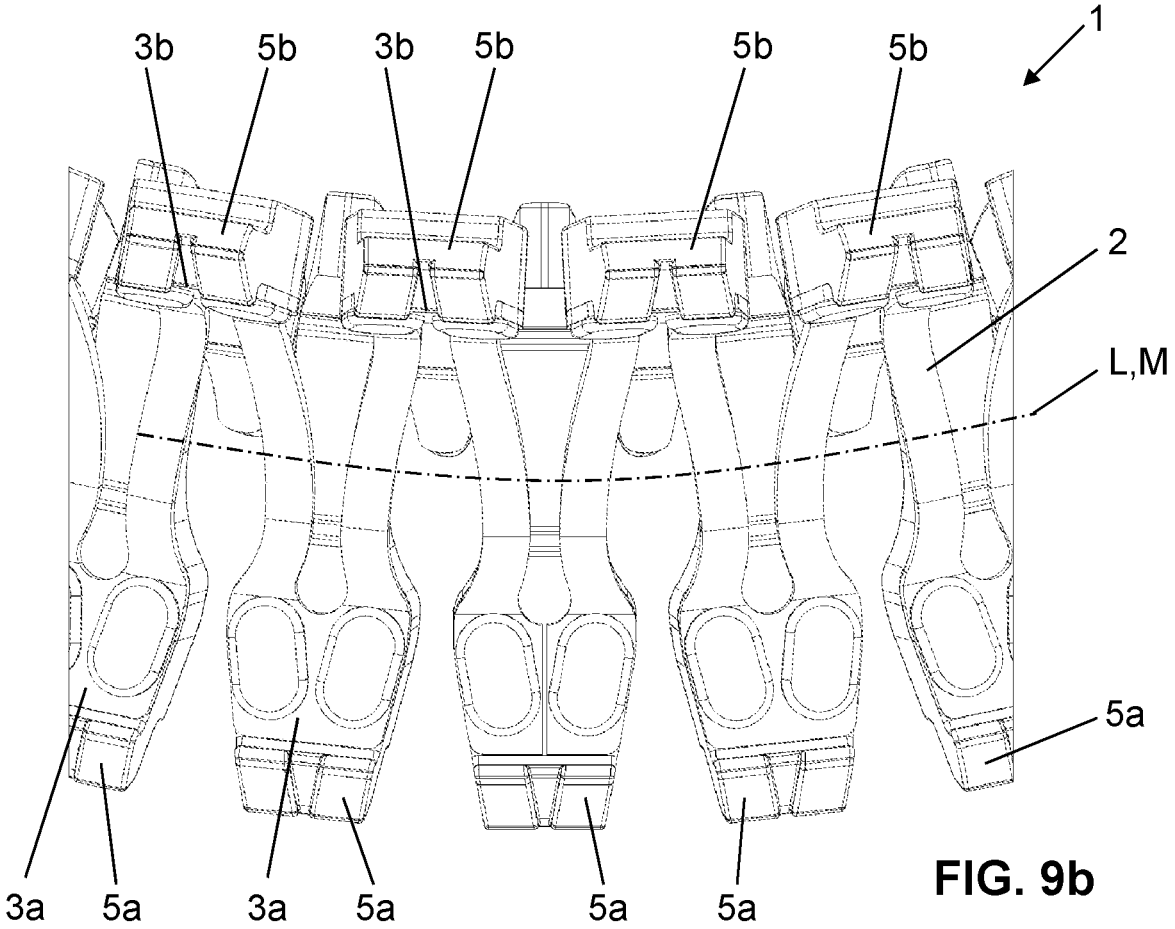
FIG. 9*b* shows a view of a detail of FIG. 9*a;*
Figure 9C:
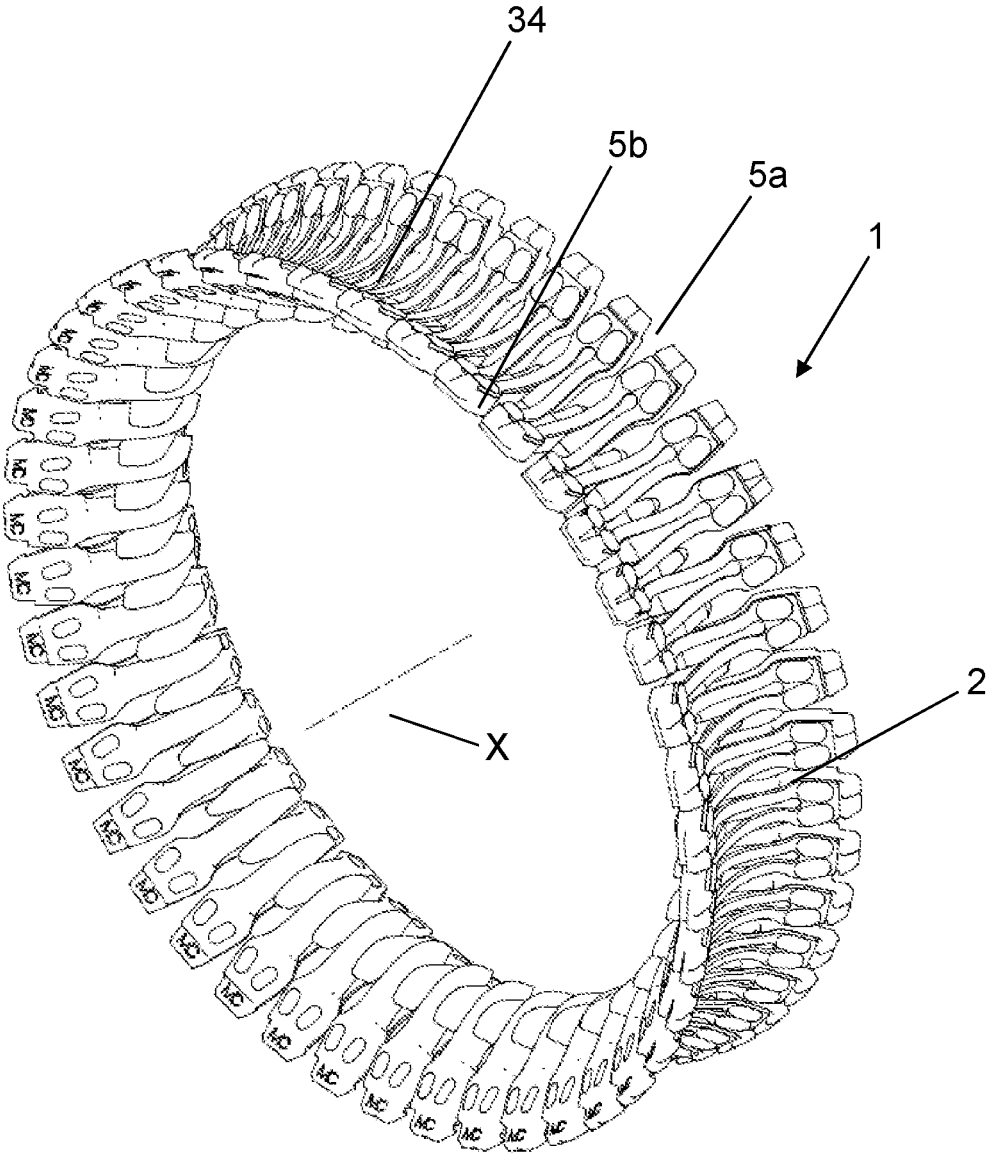
FIG. 9*c* shows a perspective view of a detail of FIG. 9*a;*

In particular, FIG. 9*c* clearly shows that the orientation of the contact parts 5 is in the direction of the center axis X, that is to say transverse in relation to the longitudinal direction of the carrier strip.

FIGS. 10*a* to 10*d* show a schematic view of a second installation situation of a contact element 1. In this case, the contact element 1 can be designed in accordance with the present invention, in particular according to the preceding embodiments.

Here, the longitudinal direction of the carrier strip 2 resp. the line M extend around a center axis X. FIGS. 10*a* to 10*d* substantially show the installation situation on the outer side of a plug, wherein the second contact sections 7 are then situated in a groove in a socket.

Figure 10C:
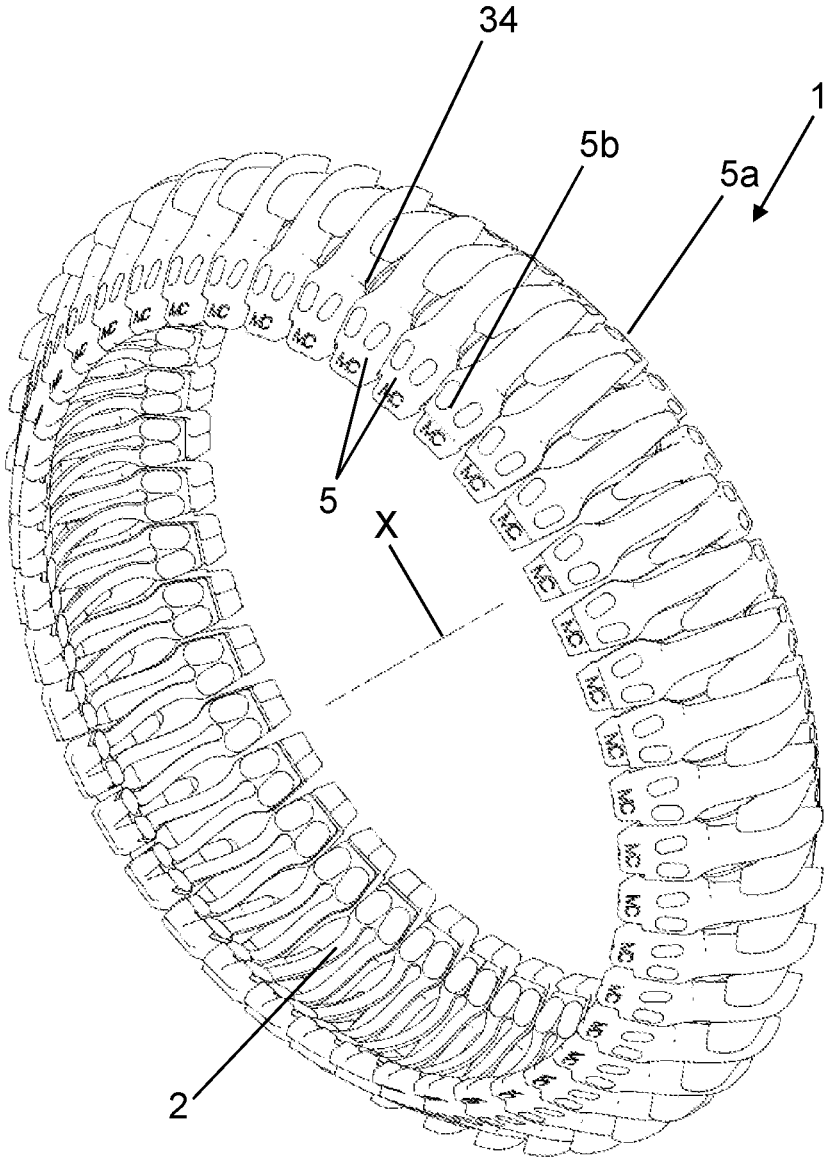
FIG. 10*c* shows a perspective view of a detail of FIG. 10*a*.

FIG. 10C in particular clearly shows that the orientation of the contact parts 5 is in the direction of the center axis X, that is to say transverse in relation to the longitudinal direction of the carrier strip.

In the case of both configurations according to FIGS. 9*a* to 9*c* and 10*a* to 10*c*, the ends 34 of the carrier strip 2 are connected to one another, so that the result is a contact element that extends around a center axis X, wherein the two ends 34 are preferably connected to one of said contact parts 5, 5*a*, 5*b*.

The invention claimed is:

1. A contact element for establishing electrical contact between two contact pieces, comprising a carrier strip that extends in a longitudinal direction, and a plurality of contact parts each having at least one first contact section for making contact with one of the two contact pieces, at least one second contact section for making contact with the other of the two contact pieces, and also having at least one fastening section for fastening one of the plurality of contact parts to a fastening spot at the carrier strip, wherein a line extends through the carrier strip in the longitudinal direction, and wherein the contact parts are situated in relation to the carrier strip in such a way that the contact parts can be pivoted about a pivot line, which pivot line is situated in a manner angularly inclined at an angle of less than 30° in relation to said line.

2. The contact element according to claim 1, wherein the contact part can be moved relative to a contact face of a corresponding contact piece during the pivoting about the pivot line, and wherein movement of the contact part runs transverse to the pivot line.

3. The contact element according to claim 1, wherein the second contact section is situated in a region of the fastening section, wherein said one contact part is formed with a rounded portion in the second contact section, which rounded portion extends around a rounded portion axis, which runs parallel in relation to the longitudinal direction, and wherein the rounded portion axis and the pivot line run in a substantially collinear manner in relation to one another.

4. The contact element according to claim 1, wherein the second contact section surrounds the carrier strip in a region of its outer edge, and/or wherein the carrier strip is formed from a flat strip whose thickness is several times smaller than a width of said flat strip, and/or wherein the fastening spots are arranged in an edge region of the carrier strip.

5. The contact element according to claim 1, wherein the carrier strip has a substantially constant cross section over its length in the longitudinal direction and is substantially rigid as seen in the longitudinal direction.

6. The contact element according to claim 1, wherein the carrier strip is designed in such a way that, when a force is applied to the carrier strip, the length of the carrier strip changes in the longitudinal direction.

7. The contact element according to claim 1, wherein contact parts are arranged on either side of the carrier strip, or wherein contact parts are arranged on one side of the carrier strip.

8. The contact element according to claim 1, wherein the contact parts extend away from the respective fastening spot, by way of which a corresponding contact part is connected to the carrier strip, over the line, which extends in the longitudinal direction.

9. The contact element according to claim 1, wherein contact parts are arranged on either side of the carrier strip, and wherein there is an intermediate space between two contact parts that are arranged in an adjacent manner on the same side, it being possible for a contact part that is arranged on the other side to protrude into said intermediate space.

10. The contact element according to claim 1, wherein a second contact part extends into the intermediate space that is situated between two adjacent first contact parts, and a first contact part extends into the intermediate space that is situated between two adjacent second contact parts.

11. The contact element according to claim 1, wherein contact parts are arranged at the carrier strip to the left and to the right with respect to the line, and wherein the contact parts are arranged offset in relation to one another in the direction of the line of the contact parts.

12. The contact element according to claim 1, wherein the first contact part, as seen from its fastening spot, extends in such a way that the first contact section, as seen transverse in relation to the longitudinal direction, extends beyond a second contact part in such a way that, in the event of a contact movement from the side of the second contact part, the first contact part is first contacted by the contact piece.

13. The contact element according to claim 1, wherein the carrier strip is designed in a manner bent about a line that is situated between the fastening spots, so that the surface of the fastening spots, which are arranged on one side of the line, is situated in a manner inclined at an angle in relation to the surface of the fastening spots, which are arranged on the other side of the line.

14. The contact element according to claim 13, wherein said bent is provided in a curved manner and/or bent once and/or bent several times.

15. The contact element according to claim 1, wherein the first contact section forms a free end with respect to the carrier strip and, at least in the non-deflected state, protrudes away from or sticks out of the carrier strip, and wherein the free end protrudes through the carrier strip through a recess in the carrier strip in the contact position.

16. The contact element according to claim 1, wherein the contact part is designed with a rounded portion in the first contact section, which rounded portion extends around a rounded portion axis which runs parallel in relation to the longitudinal direction.

17. The contact element according to claim 1, wherein a cross section of the contact part in a region of the fastening section is larger than a cross section of the contact part in a region of the first contact section.

18. The contact element according to claim 1, wherein a cross section of the contact part in a region of the fastening section is larger than a cross section of the contact part in a region of the second contact section, or wherein, as seen in the longitudinal direction, a cross section of the contact part in a region of the fastening section is substantially equal to a cross section in a region of the second contact section.

19. The contact element according to claim 1, wherein the second contact section of the contact part is situated in relation to the carrier strip in such a way that the carrier strip is not connected to a contact piece in a contact position.

20. The contact element according to claim 1, wherein the contact part is connected to the fastening spot by means of the fastening section by way of at least one plastically deformable connecting element, and wherein the connecting element is formed in one piece with the contact part.

21. The contact element according to claim 20, wherein the at least one plastically deformable connecting element comprises a rivet.

22. The contact element according to claim 1, wherein the ends of the carrier strip are connected to one another, resulting in a contact element that extends around a center axis, wherein the two ends are preferably connected to one of said contact parts, or wherein the ends are connected to one another by way of a separate element.

23. The contact element according to claim 1, wherein the line is a center line.

24. The contact element according to claim 1, wherein the pivot line is situated parallel in relation to said line.

25. An arrangement comprising a contact element and also a first contact piece and a second contact piece, wherein said contact element comprising a carrier strip that extends in a longitudinal direction, and a plurality of contact parts each having at least one first contact section for making contact with one of the two contact pieces, at least one second contact section for making contact with the other of the two contact pieces, and also having at least one fastening section for fastening the contact part to a fastening spot at the carrier strip, wherein a line extends through the carrier strip in the longitudinal direction, wherein the contact parts are situated in relation to the carrier strip in such a way that the contact parts can be pivoted about a pivot line, which pivot line is situated in a manner angularly inclined at an angle of less than 30° in relation to said line, and wherein the contact element abuts, by way of its first contact sections, against the first contact piece and, by way of the second contact sections, against the second contact piece.

26. The arrangement according to claim 25, wherein the first contact piece is a socket part that extends around a center axis and the second contact piece is a pin part that extends around the center axis, wherein the carrier strip extends around the center axis, wherein the longitudinal direction is situated transverse in relation to the center axis and extends around said center axis, wherein the pivot line extends around the center axis of the socket part and the pin part, and/or wherein the contact parts can be brought into contact with the first contact piece by way of the respective first contact sections, and that the contact parts are in contact with the second contact piece by way of the respective second contact sections, and wherein the distance between opposing contact sections is increased in the event of a contact movement.

27. The contact element according to claim 25, wherein the pivot line is situated parallel in relation to said line.

* * * * *